US009963864B2

(12) United States Patent
Lee

(10) Patent No.: US 9,963,864 B2
(45) Date of Patent: May 8, 2018

(54) POWERLESS AUTOMATIC FLUSHING TOILET SEAT FOR WATER TANK HAVING AIR EXHAUST AND INTAKE CONTROL FUNCTIONS ONLY THROUGH HUMAN BODY WEIGHT AND POWERLESS AUTOMATIC FLUSHING TOILET SEAT FOR WATER TANK

(71) Applicant: BESTAUTO CO., LTD., Seoul (KR)

(72) Inventor: Dong Jin Lee, Seoul (KR)

(73) Assignee: BESTAUTO CO., LTD., Seoul (KR)

( * ) Notice: Subject to any disclaimer, the term of this patent is extended or adjusted under 35 U.S.C. 154(b) by 142 days.

(21) Appl. No.: 14/915,982

(22) PCT Filed: Aug. 28, 2014

(86) PCT No.: PCT/KR2014/007998
§ 371 (c)(1),
(2) Date: Mar. 28, 2016

(87) PCT Pub. No.: WO2015/034205
PCT Pub. Date: Mar. 12, 2015

(65) Prior Publication Data

US 2016/0281344 A1 Sep. 29, 2016

(30) Foreign Application Priority Data

Sep. 3, 2013 (KR) ..... 10-2013-0105580

(51) Int. Cl.
*E03D 5/04* (2006.01)
*A47K 13/24* (2006.01)

(52) U.S. Cl.
CPC ..... *E03D 5/04* (2013.01); *A47K 13/24* (2013.01)

(58) Field of Classification Search
CPC .... E03D 5/04; E03D 9/05; E03D 5/02; E03D 5/024; E03D 5/028; E03D 5/08; E03D 5/022; E03D 5/105; A47K 13/24
(Continued)

(56) References Cited

U.S. PATENT DOCUMENTS 584,425 A * 6/1897 Strachan ..... E03D 5/04 4/246.4
627,357 A * 6/1899 Smith ..... E03D 3/04 251/17

(Continued)

FOREIGN PATENT DOCUMENTS

KR 20100022781 3/2010
KR 20100045804 5/2010

(Continued)

OTHER PUBLICATIONS

International Search Report—PCT/KR2014/007998 dated Dec. 22, 2014.

*Primary Examiner* — Benjamin R Shaw
(74) *Attorney, Agent, or Firm* — Cantor Colburn LLP

(57) ABSTRACT

Provided is a powerless automatic flushing toilet seat for a water tank having air exhaust and intake control functions only through human body weight and a powerless automatic flushing toilet seat for a water tank that can automatically control an opening/closing operation of a siphon cover through intake and exhaust of air in conjunction with an elevating operation of a human body detection unit for detecting the weight of a user.

33 Claims, 26 Drawing Sheets

(58) Field of Classification Search
USPC ..... 4/250
See application file for complete search history.

(56) References Cited

U.S. PATENT DOCUMENTS 631,097 A * 8/1899 Solomon et al. ..... E03D 5/04 251/229
858,427 A * 7/1907 Thompson ..... E03D 9/05 4/215
924,988 A * 6/1909 Henning ..... E03D 9/05 4/216
931,713 A * 8/1909 Allingham ..... E03D 5/04 251/232
963,440 A * 7/1910 Hodgson ..... E03D 5/04 4/250
975,664 A * 11/1910 Watrous ..... E03D 3/04 251/17
975,812 A * 11/1910 Watrous ..... E03D 5/04 4/240
1,004,349 A * 9/1911 Bensen ..... E03D 3/04 251/21
1,013,616 A * 1/1912 Rumsey ..... E03D 9/05 4/216
1,015,132 A * 1/1912 Bower ..... F16K 11/044 137/625.27
1,045,433 A * 11/1912 Payne ..... F16K 3/26 137/625.26
1,048,867 A * 12/1912 Payne ..... E03D 3/06 251/18
1,062,412 A * 5/1913 Payne ..... E03D 5/022 4/250
1,073,603 A * 9/1913 Hansen ..... E03D 5/04 251/322
1,257,331 A * 2/1918 Duff ..... E03D 9/05 4/215
1,339,585 A * 5/1920 Sloan ..... E03D 5/04 4/250
1,449,439 A * 3/1923 Phillips ..... E03D 5/04 4/213
1,803,958 A * 5/1931 Cadwell ..... E03D 3/06 251/19
2,164,503 A * 7/1939 Desroche ..... E03D 1/266 251/144
5,369,816 A * 12/1994 Chen ..... E03D 5/04 4/405
5,410,766 A * 5/1995 Schumacher ..... E03D 5/04 4/250
2007/0044216 A1* 3/2007 Cosby ..... A47K 13/10 4/246.1
2016/0160486 A1* 6/2016 Shin ..... E03D 5/04 4/408

FOREIGN PATENT DOCUMENTS

KR 20100064623 6/2010
KR 101071981 10/2011

* cited by examiner

POWERLESS AUTOMATIC FLUSHING TOILET SEAT FOR WATER TANK HAVING AIR EXHAUST AND INTAKE CONTROL FUNCTIONS ONLY THROUGH HUMAN BODY WEIGHT AND POWERLESS AUTOMATIC FLUSHING TOILET SEAT FOR WATER TANK

TECHNICAL FIELD

The present invention relates to a powerless automatic flushing toilet seat for a water tank and, more particularly, to a powerless automatic flushing toilet seat for a water tank having air exhaust and intake functions only through human body weight whereby the toilet seat can automatically control opening and closing of a siphon cover in response to vertical movement of body sensing unit for sensing the weight of a user and can automatically control opening and closing of the siphon cover by sucking and exhausting air, and a powerless automatic flushing toilet seat for a water tank.

BACKGROUND ART

In general, a toilet is designed to discharge excreta with washing water supplied when a lever is operated to a sewage disposal tank after a user uses an indoor toilet, but recently, a "Device for non-power auto-flush of chamber pot" that automatically flushes using water pressure rather than a lever has been disclosed in Korean Patent Application Publication No. 10-2010-0022781.

According to this patent document, when a user sits on a toilet seat, water is supplied to an operation unit from a hydrant through a water pipe opened by the weight of the user, a cylinder rod is pressed and moved while compressing a spring by the pressure of the water supplied to the operation unit, and whether the waste from the user is urine or feces is determined in accordance with the movement distance of the cylinder rod. Thereafter, when the user stands up, the water moving the cylinder rod is supplied to a flushing unit by restoring force of the compressed spring, whereby flushing water corresponding to the excrement is discharged and removes the excrement.

However, according to the patent document, when the pressure of the water supplied from a hydrant is lower than the tension of the spring, the cylinder is not pressed and moved, it is difficult to determine whether the waste from the user is urine or feces and flushing is not appropriately performed.

Further, even if the pressure of water that is supplied from a hydrant is normal, when excrement is simultaneously discharged from a plurality of toilets, water pressure is distributed and weakened, so the cylinder rod cannot be moved to the position where excreta is determined and flushing water for urine is discharged. Accordingly, the toilets are clogged with remaining excreta or an offensive odor is caused with unsanitary problems. Further, it is troublesome to have to flush by manually operating the lever to remove the remaining excreta.

Further, the operation unit that is operated by water pressure is complicated, so productivity is low, and there are many parts, so water leaks at their joints or dirt is accumulated in the pipes, which causes malfunction.

Recently, for solving the problems, there is Korean Patent No. 10-1071981, titled "Body weight by dividing the energy-only feces toilet seat capable of automatic water in".

According to this document, when a user sits on the toilet seat, the toilet seat is moved down by the weight of the user, the gap between first and second loading rollers decreases, tension of a loading wire is removed, and a loading wire-fixing member fixed to the loading wire is locked to a separation member on a flushing wire-fixing member fixed to an end of a flushing wire by a restoring force of a loading spring. When a moving contact member that moves while pressing fluid with downward movement of the toilet seat presses an excreta determining unit, the excreta is determined as urine, and when a cylinder rod presses the excreta determining unit, the excreta is determined as feces. When the user stands up from the toilet seat, the amount of fluid is adjusted in accordance with opening/closing of a hole depending on the determined urine or feces, the toilet seat is returned, the gap between the first and second loading rollers is increased, and the loading wire is tensed and pulls the flushing wire-fixing member and the flushing wire, so flushing water corresponding to the excreta is discharged into the toilet body and removes the excreta.

However, according to this configuration, when fluid is supplied to a cylinder in accordance with the weigh of the user who sits on and stands up from the toilet seat, the fluid flows through a complicated system and there are many parts, so assembling is difficult and the manufacturing cost is high, which deteriorates economical efficiency.

Further, maintenance is difficult and a defective proportion is high due to possibility of leaking of the fluid at the joints of the parts, and the operation time depends on the amount of injected oil and a viscosity difference according to a temperature difference, so malfunction frequently occurs. Furthermore, water is not supplied or keeps being supplied due to an on/off error of a separate pipe valve, so reliability of the product is deteriorated.

DISCLOSURE

Technical Problem

The present invention has been made in consideration of the problems of the related art and an object of the present invention is to provide a powerless automatic flushing toilet seat for a water tank having air exhaust and intake control functions only through a human body weight that can be simply assembled with less parts and can be manufactured at a low cost by simplifying the configuration that automatically controls opening/closing of a siphon cover in response to vertical movement of a body sensing unit for sensing the weight of a user, and a powerless automatic flushing toilet seat for a water tank.

Another object of the present invention is to provide a powerless automatic flushing toilet seat for a water tank having air exhaust and intake control functions only through a human body weight, the toilet seat being more useful because it can automatically control opening/closing of a siphon cover by sucking and discharging air in response to vertical movement of a body sensing unit that senses the weight of a human body and can automatically and differently flush depending on excreta in accordance with toilet paper disposal time, and a powerless automatic flushing toilet seat for water tank.

Another object of the present invention is to provide a powerless automatic flushing toilet seat for a water tank having air exhaust and intake control functions only through a human body weight that prevents malfunction due to oil leakage and a temperature change or prevents water pipes and oil pipes from being clogged with dirt by automatically flushing in response to intake air, and a powerless automatic flushing toilet seat for a water tank.

Technical Solution

A powerless automatic flushing toilet seat for a water tank having air exhaust and intake functions only through human body weight, includes: a body sensing unit pressing seat springs and guiding a toilet seat that moves down when a user sits on the toilet seat, and guiding the toilet seat that moves up using a restoring force of the seat springs and sensing a human body when the user stands up from the toilet seat; an operation unit including a loading member having a loading force for pulling a flushing wire connected to a siphon cover in response to downward movement of the body sensing unit, and removing excreta with rotation of the siphon cover by removing a loading force of the loading member and pulling the flushing wire through an unloading member operating in response to upward movement of the body sensing unit; an unloading unit keeping a loading force in the flushing wire in response to downward movement of the body sensing unit and removing the kept loading force in response to upward movement of the body sensing unit; and an adjusting unit adjusting operation time of the operation unit by discharging internal air in response to downward movement of the body sensing unit and by adjusting the amount of air flowing inside in response to upward movement of the body sensing unit at a compressed level of an air adjusting filter by a bolt.

A powerless automatic flushing toilet seat for a water tank having air exhaust and intake functions only through human body weight, includes: a body sensing unit pressing seat springs and guiding a toilet seat that moves down when a user sits on the toilet seat, and guiding the toilet seat that moves up using a restoring force of the seat springs and sensing a human body when the user stands up from the toilet seat; an excreta discriminating unit discriminating excreta of a user on the basis of movement distance until the body sensing unit starts to move up, in response to downward movement of the body sensing unit; an operation unit including a loading member having a loading force for pulling a flushing wire connected to a siphon cover in response to downward movement of the body sensing unit, and removing excreta with rotation of the siphon cover by removing the loading force of the loading member and pulling the flushing wire through an unloading member operating in response to upward movement of the body sensing unit; an unloading unit keeping a loading force in the flushing wire in response to downward movement of the body sensing unit and removing the kept loading force in response to upward movement of the body sensing unit; and an adjusting unit adjusting operation time of the operation unit by discharging internal air in response to downward movement of the body sensing unit and by adjusting the amount of air flowing inside in response to upward movement of the body sensing unit at a compressed level of an air adjusting filter by a bolt.

Advantageous Effects

According to the present invention, there is provided a simple configuration for automatically controlling opening/closing of a siphon cover in response to vertical movement of a body sensing unit for sensing the weight of a user, so the number of parts is decreased, assembling is simple, and manufacturing cost is reduced, so economical efficiency is improved.

Further, according to the present invention, it is possible to automatically control opening/closing of a siphon cover by sucking and discharging air in response to vertical movement of a body sensing unit for sensing the weight of a user for more convenient use, so it is possible to improve reliability of a product for users.

Further, according to the present invention, flushing is automatically performed by sucked air, so it is possible to prevent malfunction due to oil leakage and a temperature change or prevent dirt from being accumulated in a water pipe or an oil pipe, so it is possible to improve convenience for use and increase the life span of a product.

Figure 1:
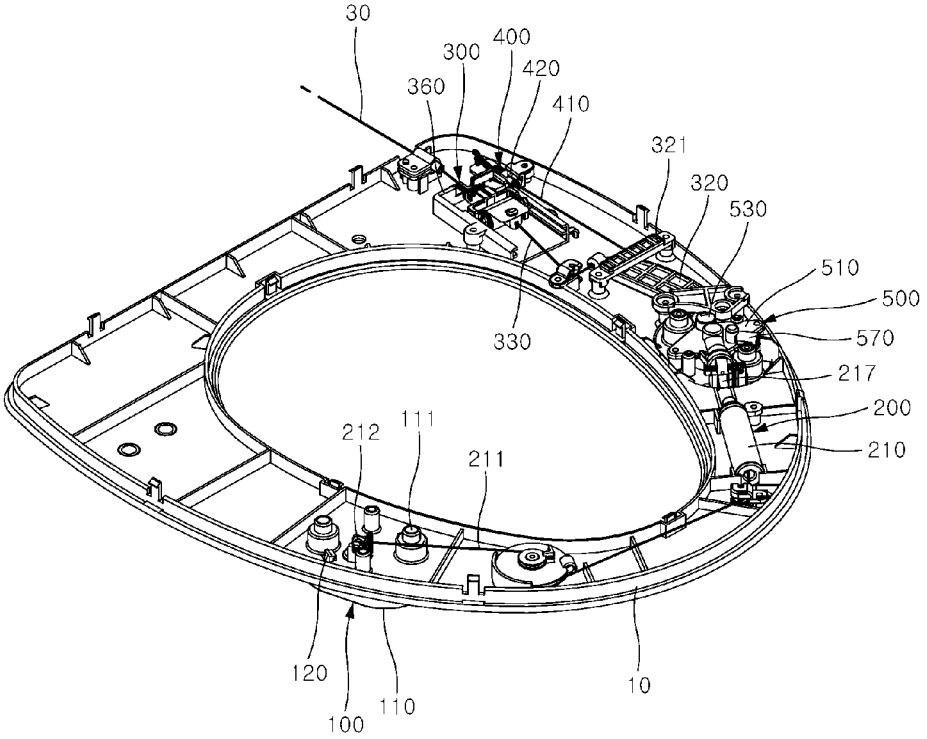
FIG. 1 is a perspective view of the present invention.

| <Description of the Reference Numerals in the Drawings> | |
|---|---|
| 100, 100': Body sensing unit | 110: Sensing plate |
| 120: Hook | 130: Seat spring |
| 200: Excreta discriminating unit | |
| 210: Cylinder body | 300: Operation unit |
| 310: Pressing member | |
| 320: Lever | 330: Loading wire |
| 340: Loading member | 350: Loading guide |
| 360: Loading guide-guiding member | |
| 400: Unloading unit | 410: Unloading wire |
| 420: Unloading wire-fixing member | |
| 430: Unloading wire-supporting member | |
| 440: Unloading member | 450: Loading projection |
| 500: Adjusting unit | 510: Adjusting body |
| 520: Cover member | |
| 530: Anti-separation member | |
| 540: Vertical guide member | 550: Air adjusting filter |
| 560: Bolt | |
| 570: Toilet paper-disposal time adjuster | |

MODE FOR INVENTION

Figure 2:
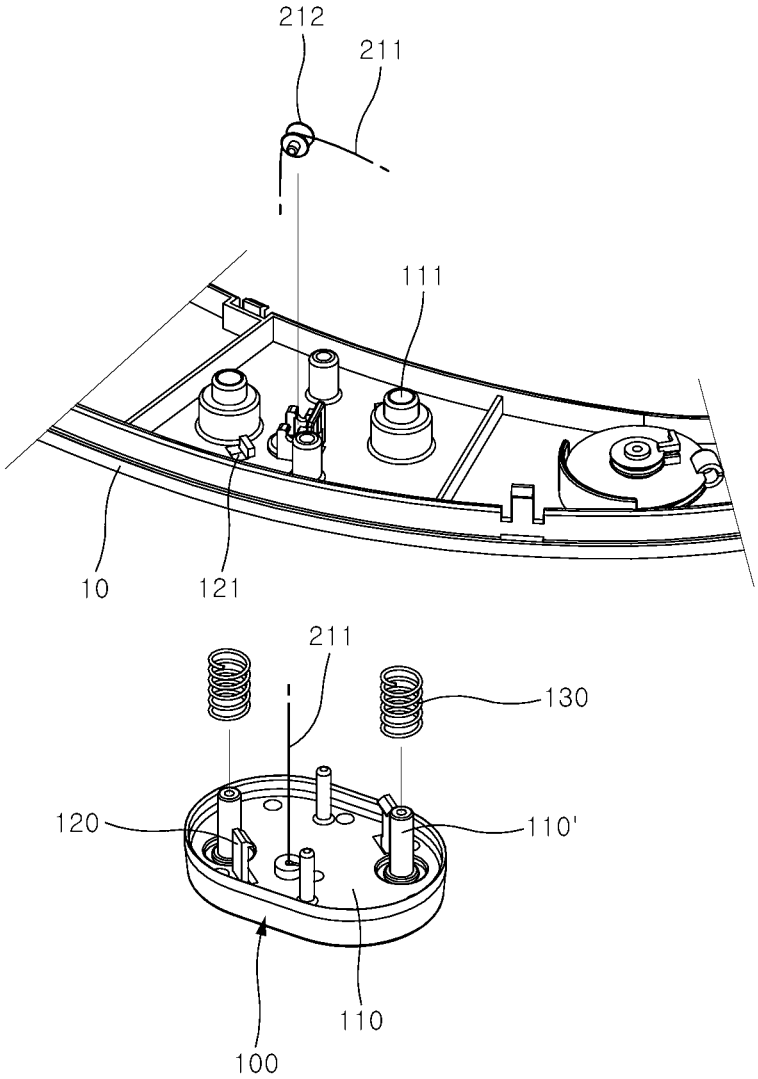
FIG. 2 is an exploded perspective view of a body sensing unit of the present invention.
Figure 3:
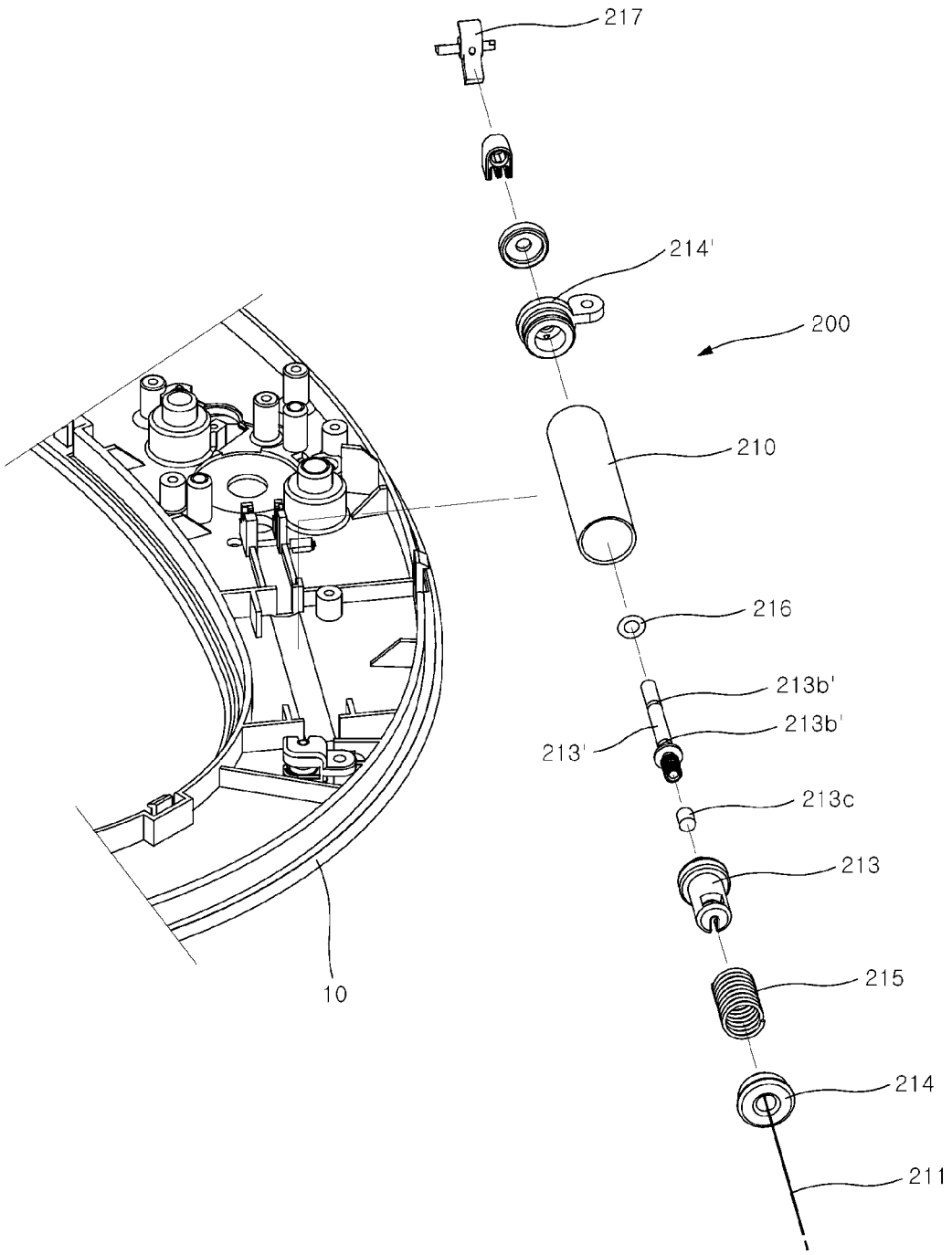
FIG. 3 is an exploded perspective of an operation unit and an unloading unit of the present invention.
Figure 4:
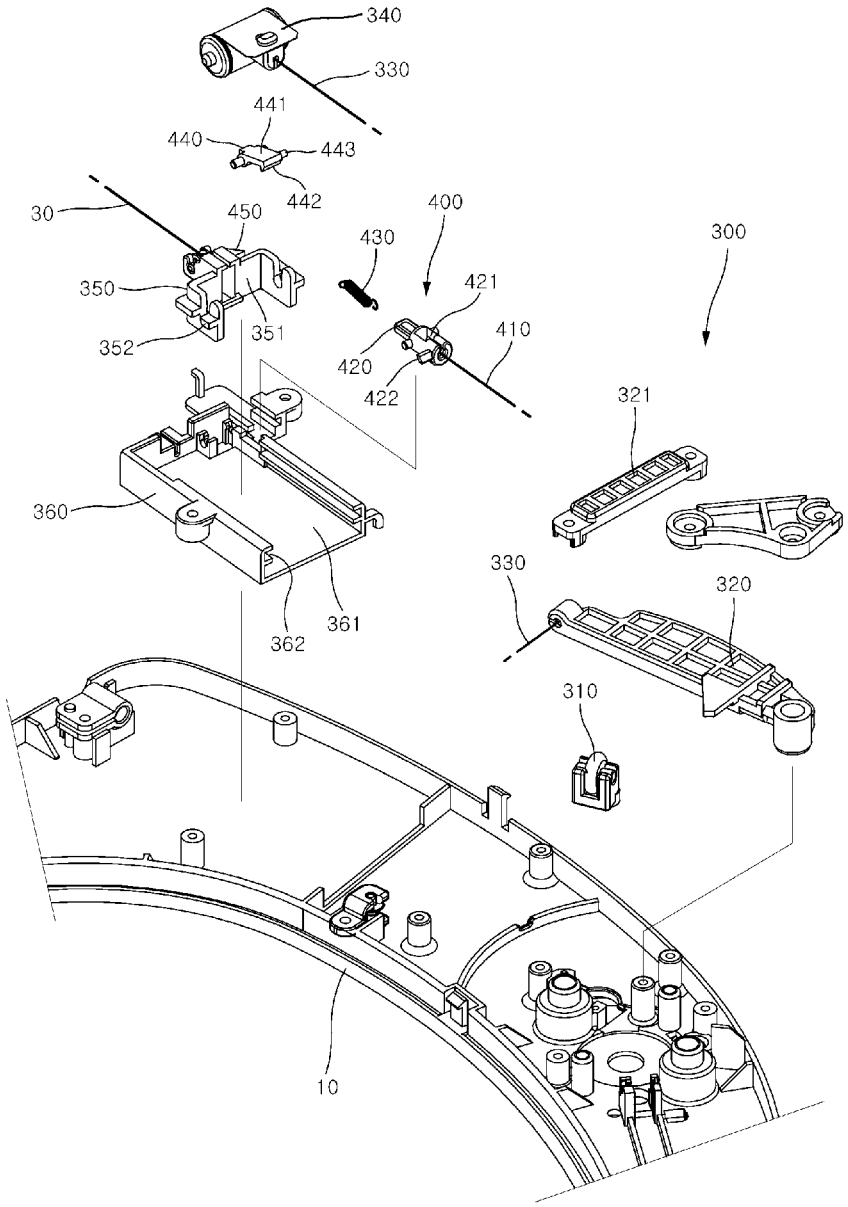
FIG. 4 is an exploded perspective view of an adjusting unit of the present invention.
Figure 5:
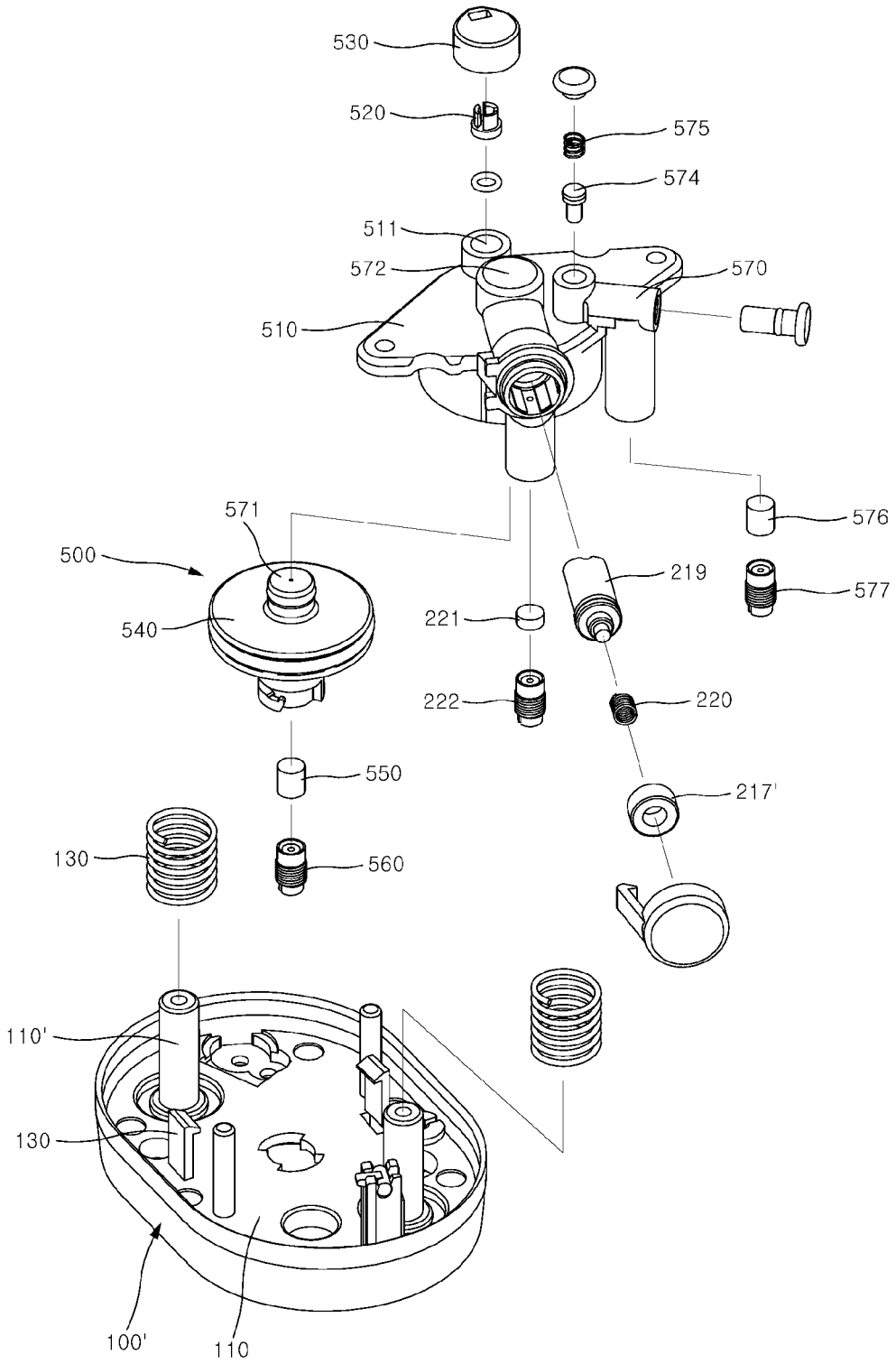
FIG. 5 is an exploded perspective view of an excreta discriminating unit of the present invention.

The present invention is described hereafter in detail with reference to the accompanying drawings. FIG. 1 is a perspective view of the present invention, FIG. 2 is an exploded perspective view of a body sensing unit of the present invention, FIG. 3 is an exploded perspective of an operation unit and an unloading unit of the present invention, FIG. 4 is an exploded perspective view of an adjusting unit of the present invention, and FIG. 5 is an exploded perspective view of an excreta discriminating unit of the present invention.

The present invention includes: a body sensing unit 100 and 100' that presses seat springs 130 and guides a toilet seat 10 moving down when a user sits on the toilet seat 10, and that guides the toilet seat 10 moving up using a restoring force of the seat springs 130 and senses a human body when the user stands up from the toilet seat 10; an operation unit 300 that includes a loading member 340 having a loading force for pulling a flushing wire 30 connected to a siphon cover 20 in response to downward movement of the body sensing unit 100' and that removes excreta with rotation of the siphon cover 20 by removing the loading force of the loading member 340 and pulling the flushing wire 30 through an unloading member 440 operating in response to upward movement of the body sensing unit 100'; an unloading unit 400 that keeps a loading force in the flushing wire 30 in response to downward movement of the body sensing unit 100' and removes the kept loading force in response to upward movement of the body sensing unit 100'; and an adjusting unit 500 that adjusts operation time of the operation unit 300 by discharging internal air in response to downward movement of the body sensing unit 100' and by adjusting the amount of air flowing inside in response to upward movement of the body sensing unit 100' at a compressed level of an air adjusting filter 550 by a bolt 560.

The present invention includes: a body sensing unit 100 and 100' that presses seat springs 130 and guides a toilet seat 10 moving down when a user sits on the toilet seat 10, and that guides the toilet seat 10 moving up using a restoring force of the seat springs 130 senses a human body when the user stands up from the toilet seat 10; an excreta discriminating unit 200 that discriminates excreta of a user on the basis of movement distance until the body sensing unit 100 starts to move up, in response to downward movement of the body sensing unit 100; an operation unit 300 that includes a loading member 340 having a loading force for pulling a flushing wire 30 connected to a siphon cover 20 in response to downward movement of the body sensing unit 100' and that removes excreta with rotation of the siphon cover 20 by removing the loading force of the loading member 340 and pulling the flushing wire 30 through an unloading member 440 operating in response to upward movement of the body sensing unit 100'; an unloading unit 400 that keeps a loading force in the flushing wire 30 in response to downward movement of the body sensing unit 100' and removes the kept loading force in response to upward movement of the body sensing unit 100'; and an adjusting unit 500 that adjusts operation time of the operation unit 300 by discharging internal air in response to downward movement of the body sensing unit 100' and by adjusting the amount of air flowing inside in response to upward movement of the body sensing unit 100' at a compressed level of an air adjusting filter 550 by a bolt 560.

The body sensing unit 100 and 100' includes a sensing plate 110 coupled to a toilet through a hole 11 formed in the toilet seat 10, a hook 120 coupled to a hook hole 121 formed through the toilet 10 to prevent separation of the sensing plate 110 from the toilet seat 10, and seat springs 130 disposed between the sensing plate 110 and the toilet seat 10 to restore the toilet seat 10.

The operation unit 300 includes a pressing member 310 mounted on the sensing plate 110 coupled to the body sensing unit 100', a lever 320 rotating from a first side to a second side about an end of the toilet seat 10 when being pressed by the pressing member 310, a loading wire 330 pulling the loading member 340 when the lever 320 is rotated, the loading member 340 fixed to the loading wire 330 and keeping a force for pulling a flushing wire 30 when the lever 320 is rotated, a loading guide 350 fixing the flushing wire 30 and guiding the loading member 340, and a loading guide-guiding member 360 guiding the loading guide 350.

The pressing member 310 may have an outer side curved or inclined to be able to move the lever 320.

The operation unit further includes a rotational unloading member 321 controlling rotation of the lever 320.

The loading member 340 may be any one of a spiral spring, a leaf spring, and a coil spring.

The loading guide 350 has a moving guide body 351 accommodating the loading member 340 and fixing the flushing wire 30 and moving guide projections 352 protruding at both sides of the moving guide body 351 to be fitted in guide grooves 362 of the loading guide-guiding member 360.

The loading guide-guiding member 360 has a guide body 361 accommodating the loading guide 350 and fixed to the toilet seat 10 and the guide grooves 362 formed inside the guide body 361 and retaining the moving guide projections 352 of the loading guide 350.

The unloading member 400 includes: an unloading wire 410 fixed to a side of the body sensing unit 100'; an unloading wire-fixing member 420 fixing a second end of the unloading wire 410 and controlling operation of the unloading member 440 when the unloading wire 410 is tensed; an unloading wire-supporting member 430 fixed to the operation unit 300 and the unloading wire-fixing member 420 to elastically support the unloading wire-fixing member 420 and the unloading wire 410; an unloading member 440 unlocking the loading guide-guiding member 360 of the operation unit 300 when the unloading wire-fixing member 420 is moved; and a loading projection 450 protruding on the loading guide 350 to keep the unloading member 400 locked.

The unloading wire-fixing member 420 has an unloading wire-fixing body 421 fixing the second end of the unloading wire 410 and an unloading wire projection 422 protruding on the unloading wire-fixing body 421 and pressing the unloading member 440 when the unloading wire 410 is moved.

The unloading wire projection 422 may be inclined.

The unloading wire-supporting member 430 may be a spring that pulls the unloading wire-fixing member 420.

The unloading member 440 has: an unlocking body 441 mounted on the loading guide-guiding member 360 to fit to the loading projection 450; and an unloading projection 442 protruding on a side of the unlocking body 441 to be pressed by the unloading wire projection 422 of the unloading wire-fixing member 420.

The adjusting unit 500 includes an adjusting body 510 having an air exhaust hole 511 and fixed to the toilet seat 10, a cover member 520 opening/closing the air exhaust hole 511, an anti-separation member 530 preventing separation of the cover member 520, and a vertical guide member 540 discharging air in the adjusting body 510 to the air exhaust hole 511 by vertically moving in the adjusting body 510 and fixed to the body sensing unit 100' to suck air outside the adjusting body 510.

The adjusting unit 500 further includes an air adjusting filter 550 coupled to a hole 541 formed through the vertical guide member 540 to adjust the amount of air flowing inside through the hole 541 and a bolt 560 inserted in the hole 541 to prevent separation of the air adjusting filter 550 and adjust the movement amount of the air in accordance with the degree of compression of the air adjusting filter 550.

The adjusting unit 500 further includes a toilet paper-disposal time adjuster 570 that adjusts the time for a user to dispose toilet paper by adjusting the downward movement time of the vertical guide member 540. The toilet paper-disposal time adjuster 570 has a toilet paper time-adjusting rib 571 protruding on the top of the vertical guide member 540, a rib groove 572 formed on the adjusting body 510 to receive the toilet paper time-adjusting rib 571, a toilet paper time-adjusting hole 573 formed through the adjusting body 510, and a toile paper time-adjusting cover member 574 inserted in the toilet paper time-adjusting hole 573 so that the toilet paper time-adjusting rib 571 opens/closes the toilet paper time-adjusting hole 573 by being coupled to and separated from the rib groove 572.

The toilet paper-disposal time adjuster 570 further has a restoring member 575 for restoring the toilet paper time-adjusting cover member 574.

The toilet paper-disposal time adjuster 570 further includes an air adjusting filter 576 coupled to an end of the toilet paper time-adjusting hole 573 to adjust the amount of air flowing inside through the toilet paper time-adjusting hole 573 and a toilet paper time-adjusting bolt 577 inserted in the toilet paper time-adjusting hole 573 to prevent separation of the air adjusting filter 576 and adjust the movement amount of the air in accordance with the degree of compression of the air adjusting filter 576.

The excreta discriminating unit 200 includes: a cylinder wire 211 fixed at a first end to the body sensing unit 100; a rod pin 213 fixing a second end of the cylinder wire 211, combined with a cylinder rod 213', and coupled to the cylinder body 210; a first cap 214 preventing separation of the rod pin 213 and coupled to a first end of the cylinder body 210; a second cap 214' coupled to a second end of the cylinder body 210 to guide the cylinder rod 213' and guiding air inside and outside the cylinder body 210 when the cylinder rod 213' is moved; a cylinder spring 215 disposed between the first cap 214 and the second cap 214'; a packing 216 fitted on the cylinder rod 213' and disposed between the second cap 214' and the cylinder rod 213'; an excreta mode-switching unit 217 discriminating excreta on the basis of whether of contact of a contact member 217' by the cylinder rod 213' moved by a restoring force of the cylinder spring 215; and a urine cover member 219 opening/closing a urine adjusting hole 218 formed through the rib groove 572 of the toilet paper-disposal time adjuster 570 using a restoring force of the restoring member 220 on the basis of whether of contact of the excreta mode-switching unit 217.

The excreta discriminating unit 200 further includes a roller 212 on the body sensing unit 100 to guide the cylinder wire 211.

The excreta discriminating unit 200 further has coupling grooves **213*b* and 213*b'* that allows the packing 216 to move to connect the air inside and outside the cylinder body 210 when the rod pin 213 returns while compressing the cylinder spring 215 and when the cylinder rod 213' presses the excreta mode-switching member 217**.

The excreta discriminating unit 200 further includes an air adjusting filter 221 coupled to an end of the urine adjusting hole 218 to adjust the amount of air flowing inside through the urine adjusting hole 218 and a urine adjusting bolt 222 inserted in the urine adjusting hole 218 to prevent separation of the air adjusting filter 221 and adjust the movement amount of the air in accordance with the degree of compression of the air adjusting filter 221.

The excreta discriminating unit 200 further includes an air adjusting filter **213*c* disposed between the cylinder rod 213' and the rod pin 213 to adjust the amount of air flowing inside and outside the cylinder body 210 through a hole 213*a* formed through the rod pin 213 combined with the cylinder rod 213'**.

The present invention includes: a body sensing unit 100 and 100' that presses seat springs 130 and guides a toilet seat 10 moving down when a user sits on the toilet seat 10, and that guides the toilet seat 10 moving up using a restoring force of the seat springs 130 senses a human body when the user stands up from the toilet seat 10; an operation unit 300 that includes a loading member 340 having a loading force for pulling a flushing wire 30 connected to a siphon cover 20 in response to downward movement of the body sensing unit 100' and that removes excreta with rotation of the siphon cover 20 by removing the loading force of the loading member 340 and pulling the flushing wire 30 through an unloading member 440 operating in response to upward movement of the body sensing unit 100'; and an unloading unit 400 that keeps a loading force in the flushing wire 30 in response to downward movement of the body sensing unit 100' and removes the kept loading force in response to upward movement of the body sensing unit 100'.

The body sensing unit 100 and 100' includes a sensing plate 110 coupled to a toilet through a hole 11 formed in the toilet seat 10, a hook 120 coupled to a hook hole 121 formed through the toilet 10 to prevent separation of the sensing plate 110 from the toilet seat 10, and seat springs 130 disposed between the sensing plate 110 and the toilet seat 10 to restore the toilet seat 10.

The operation unit 300 includes a pressing member 310 mounted on the sensing plate 110 coupled to the body sensing unit 100', a lever 320 rotating from a first side to a second side about an end of the toilet seat 10 when being pressed by the pressing member 310, a loading wire 330 pulling the loading member 340 when the lever 320 is rotated, the loading member 340 fixed to the loading wire 330 and keeping a force for pulling a flushing wire 30 when the lever 320 is rotated, a loading guide 350 fixing the flushing wire 30 and guiding the loading member 340, and a loading guide-guiding member 360 guiding the loading guide 350.

The pressing member 310 may have an outer side curved or inclined to be able to move the lever 320.

The operation unit further includes a rotational unloading member 321 controlling rotation of the lever 320.

The loading member 340 may be any one of a spiral spring, a leaf spring, and a coil spring.

The loading guide 350 has a guide body 351 accommodating the loading member 340 and fixing the flushing wire 30 and guide projections 352 protruding at both sides of the guide body 351 to be fitted in guide grooves 362 of the loading guide-guiding member 360.

The loading guide-guiding member 360 has a guide body 361 accommodating the loading guide 350 and fixed to the toilet seat 10 and the guide grooves 362 formed inside the guide body 361 and retaining the moving guide projections 352 of the loading guide 350.

The unloading member 400 includes: an unloading wire 410 fixed to a side of the body sensing unit 100'; an unloading wire-fixing member 420 fixing a second end of the unloading wire 410 and controlling operation of the unloading member 440 when the unloading wire 410 is tensed; an unloading wire-supporting member 430 fixed to the operation unit 300 and the unloading wire-fixing member 420 to elastically support the unloading wire-fixing member 420 and the unloading wire 410; an unloading member 440 unlocking the loading guide-guiding member 360 of the operation unit 300 when the unloading wire-fixing member 420 is moved; and a loading projection 450 protruding on the loading guide 350 to keep the unloading member 400 locked.

The unloading wire-fixing member 420 has an unloading wire-fixing body 421 fixing the second end of the unloading wire 410 and an unloading wire projection 422 protruding on the unloading wire-fixing body 421 and pressing the unloading member 440 when the unloading wire 410 is moved.

The unloading wire projection 422 may be inclined.

The unloading wire-supporting member 430 may be a spring that pulls the unloading wire-fixing member 420.

The unloading member 440 has: an unlocking body 441 mounted on the loading guide-guiding member 360 to fit to the loading projection 450; and an unloading projection 442 protruding on a side of the unlocking body 441 to be pressed by the unloading wire projection 422 of the unloading wire-fixing member 420.

The present invention having the configurations described above is described hereafter in detail.

First, the present invention can be operated only with the body sensing unit 100 and 100', the operation unit 300, and the unloading unit 300 and only with the body sensing unit 100 and 100', the operation unit 300, the unloading unit 400, and the adjusting unit 500, but the present invention is described hereafter in limitation to the configuration including the body sensing unit 100 and 100', the excreta discriminating unit 200, the operation unit 300, the unloading unit 400, and the adjusting unit 500.

Figure 6:
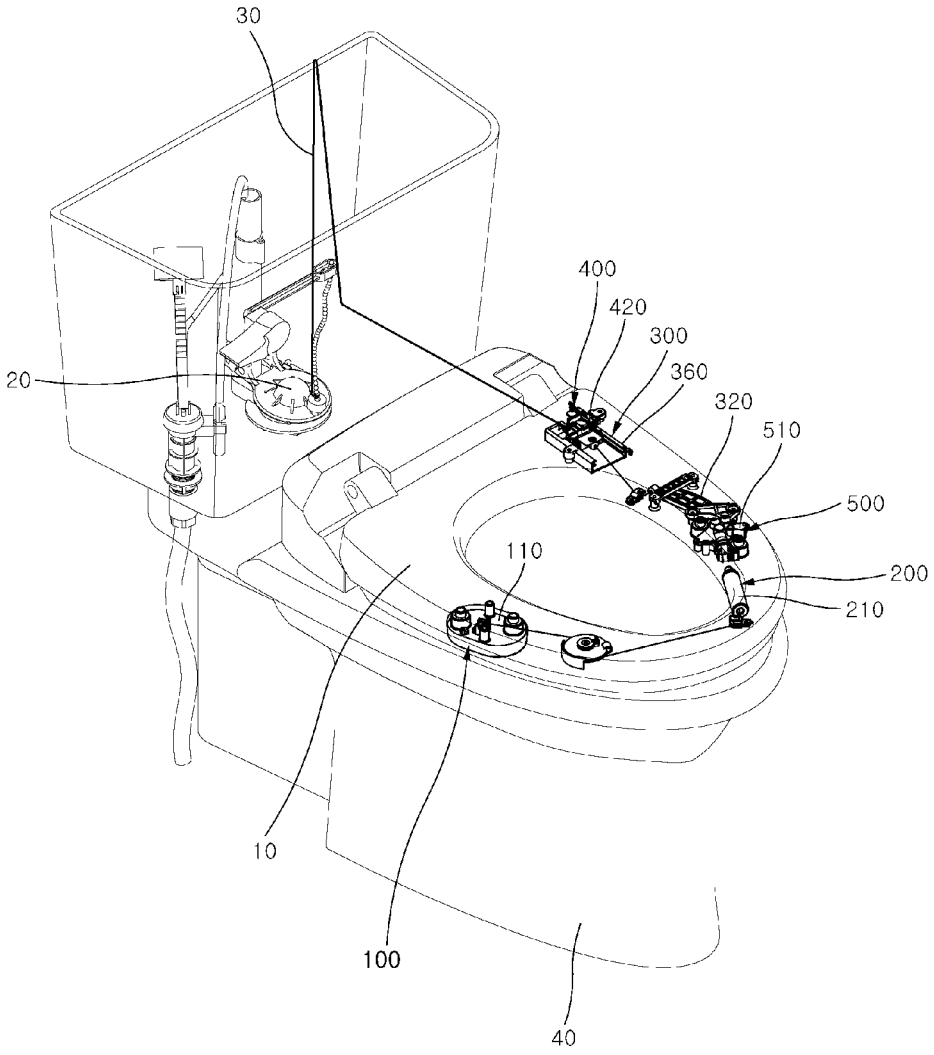
FIG. 6 is a perspective view showing an installed state of the present invention.

As shown in FIG. 6, the body sensing unit 100 and 100', the operation unit 300, the unloading unit 400, the adjusting unit 500, and the excreta discriminating unit 200 are installed in the toilet seat 10, in which the operation unit 300 is controlled by the unloading unit 400, the toilet seat 10 is placed on a toilet body 11, and the operation unit 300 and the siphon cover 200 are connected by the flushing wire 30.

Figure 7:
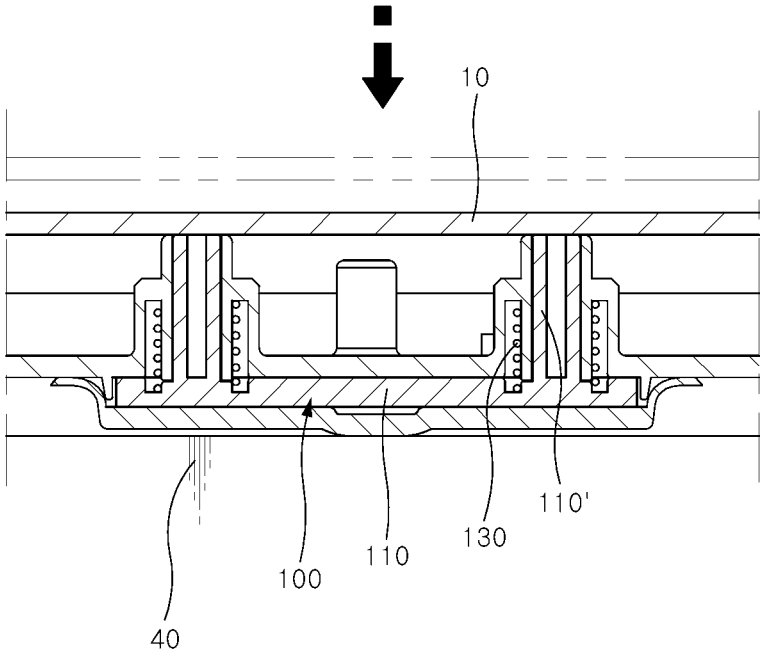
FIGS. 7 to 17 are views showing operation with a user sitting on the toilet seat of the present invention.
Figure 8:
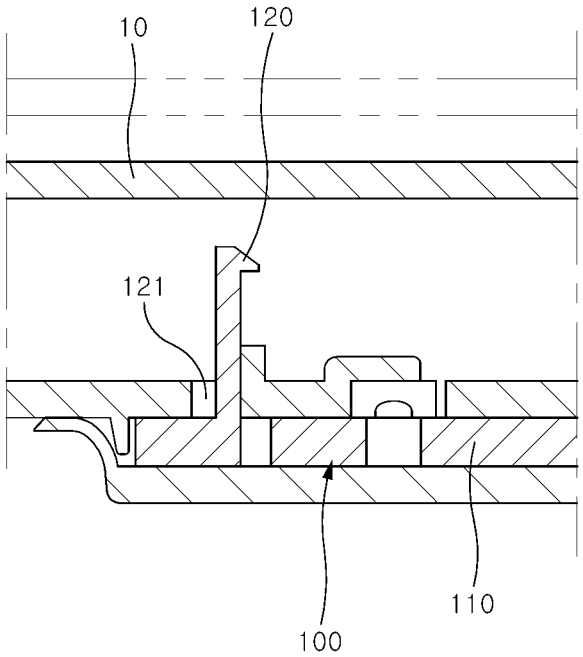
Figure 9:
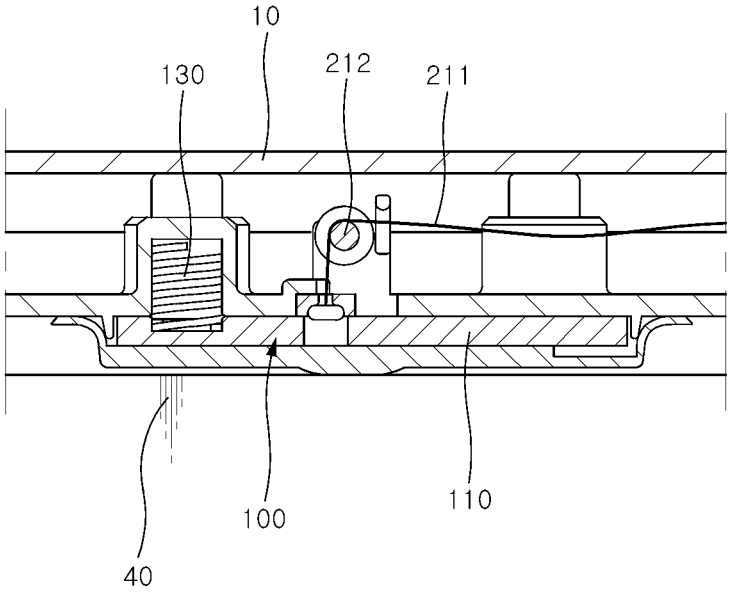
Figure 10:
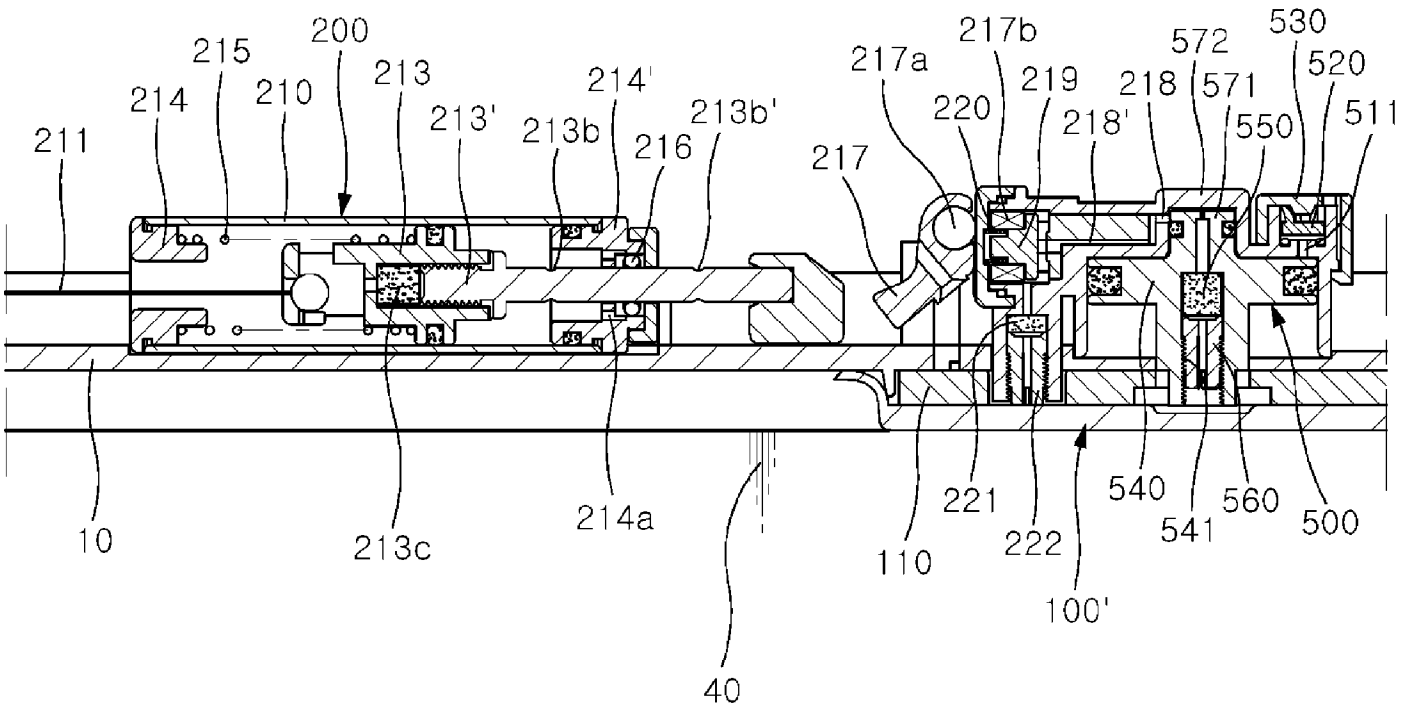
Figure 11:
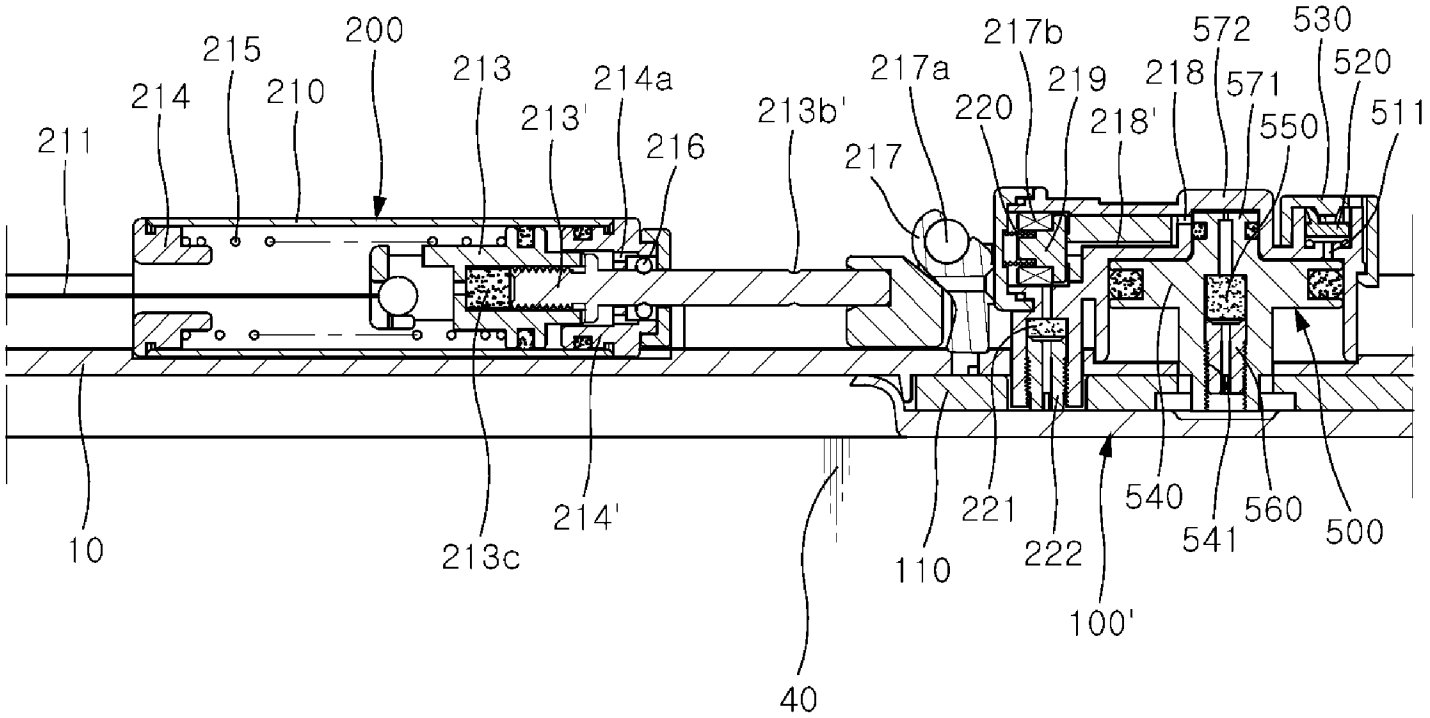
Figure 12:
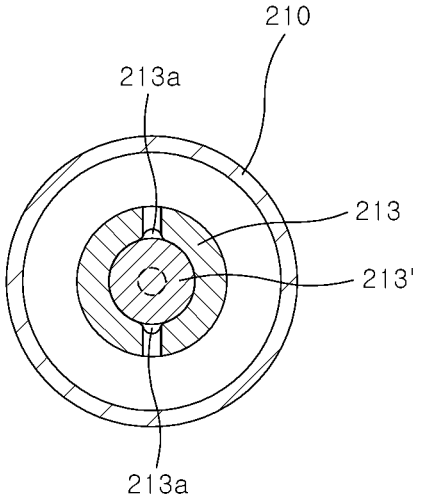
Figure 13:
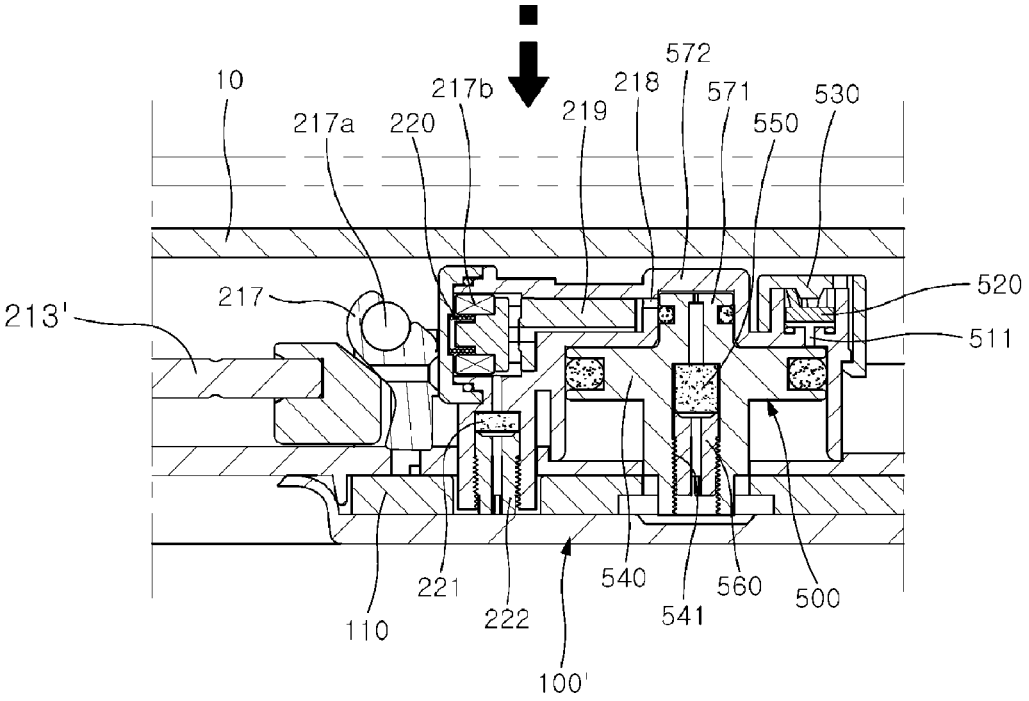

When a user sits on the toilet seat 10, as shown in FIGS. 7 and 8, the toilet seat 10 is moved by the weight of the user, the projection 110' and the hook 120 of the sensing plate 121 protrude through the hole 111 and the hook hole 121 of the body sensing unit 100 and 100' formed through the toilet seat 10, and the seat springs 130 between the toilet seat 10 and the sensing plate 110 are compressed.

Further, as the seat springs 130 between the toilet seat 10 and the sensing plate 110 are compressed, as shown in FIGS. 9 to 13, the gap between the toilet seat 10 and the body sensing unit 100 decreases, the tension of the cylinder wire 211 for the excreta discriminating unit 200 of which the first end is fixed to the body sensing unit 100 is removed, and the cylinder wire 211 with the tension removed rotates the roller 212 using the restoring force of the compressed cylinder spring 215 and moves the rod pin 213 and the cylinder rod 213' to a second side of the cylinder body 210.

The cylinder spring 215 can press the rod pin 213 using a restoring force, between the rod pin 213 and the first cap 214 at a first side of the cylinder body 210 and the cylinder rod 313' protrudes through the second cap 214' at the second side of the cylinder body 210.

As the cylinder rod 213' is moved, the packing 216 is moved over the coupling groove **213*b*' toward the coupling groove 213*b*, in which the packing 216 closes the inner side of the second cap 214' and the groove 214*a*, thereby blocking air flowing inside. Further, as the cylinder rod 213' is moved, the amount of the air flowing into the cylinder body 210 through the first cap 214 can be adjusted in accordance with the degree of compression of the air adjusting filter 213*c* disposed between the rod pin 213 and the cylinder rod 213', so the speed of the cylinder rod 213'** can be adjusted.

If the cylinder rod 213' moved by the restoring force of the cylinder spring 215 cannot pressure the excreta mode-switching member 217 and accordingly the contact member in the excreta mode-switching member 217 and the contact member **217*b* in the urine adjusting hole 218 keep in contact with each other, the excreta is determined as urine. On the contrary, if the cylinder rod 213' is moved and presses the excreta mode-switching member 217 and accordingly the contact member in the excreta mode-switching member 217 and the contact member 217*b* in the urine adjusting hole 218 are separated from each other, the excreta is determined as feces. This is because as the contact members 217*a* and 217*b* are separated from each other or brought in contact with each other, the urine cover member 219 is moved and closes the urine adjusting hole 218 by the restoring force of the restoring member 220, and when the user stands up from the toilet seat 10, the amount of air flowing into the adjusting body 510** is adjusted.

Figure 14:
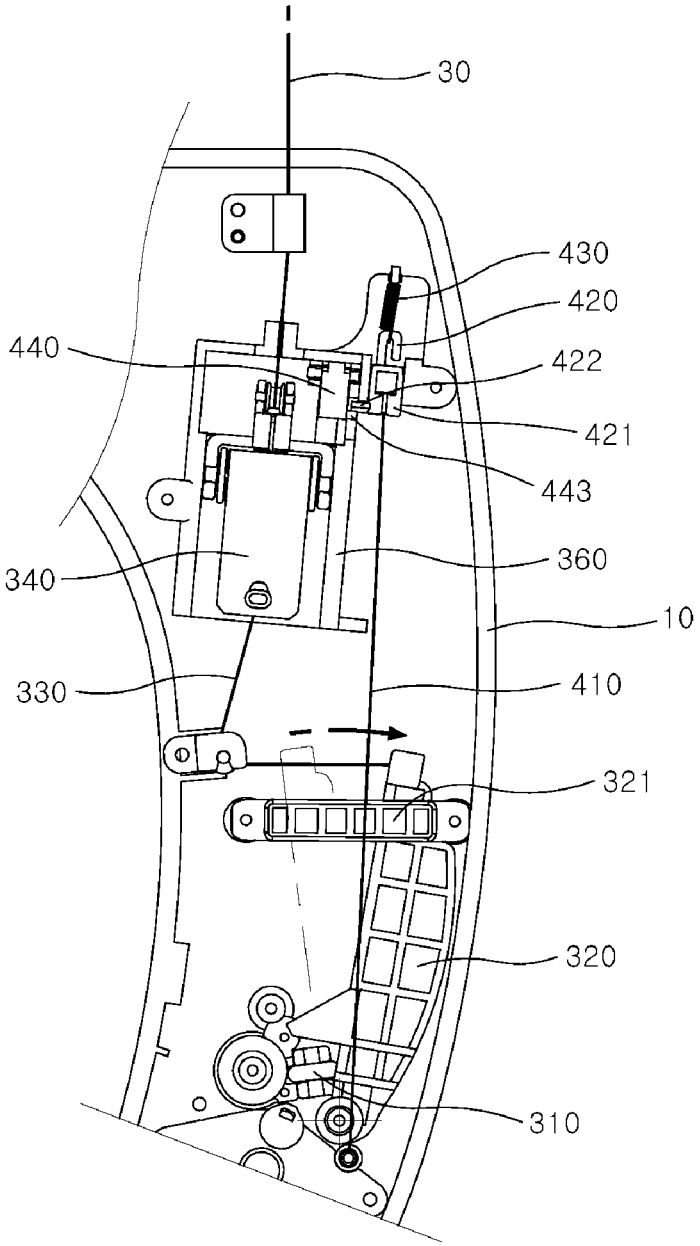
Figure 15:
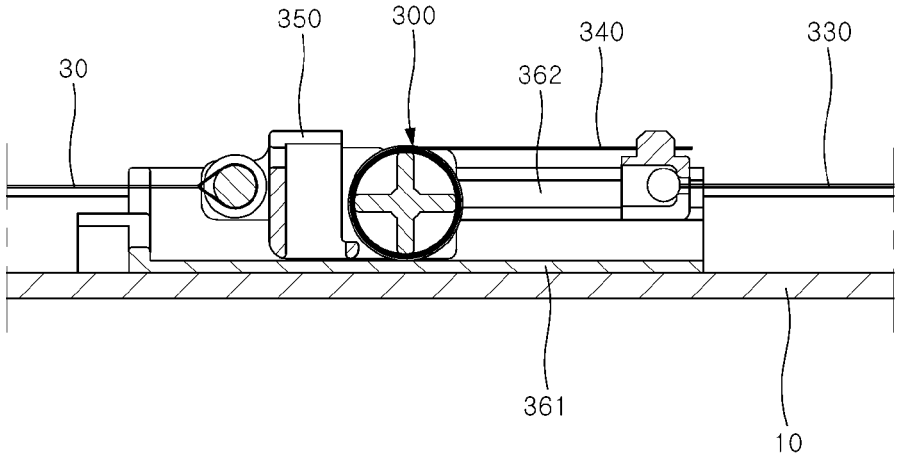

Further, as shown in FIGS. 14 and 15, the pressing member 310 of the operation unit 300 on the sensing plate 110 of the body sensing unit 100' protrudes into the toilet seat 10 and presses the lever 320.

Since the outer side of the pressing member 310 is curved or inclined, so it can press the lever 320, and when lever 320 is pressed by the pressing member 310, the lever 320 is rotated from a first side to a second side about an end.

The lever 320 can be rotated only in the rotational unloading member 321 accommodating the lever 3320 and fixed to the toilet seat 10.

As the lever 320 is rotated, the loading wire 330 connecting the lever 320 and the loading member 340 is pulled and pulls the loading member 340, in which the loading member 340 may be any one of a spiral spring, a leaf spring, and a coil spring.

When the loading member 340 stretches, only the loading member 340 stretches and the loading force of the flushing wire 30 is kept, because the unloading projection 442 of the unloading member 440 is locked to the loading projection 450 of the loading guide 350 for guiding the loading member 340.

Figure 16:
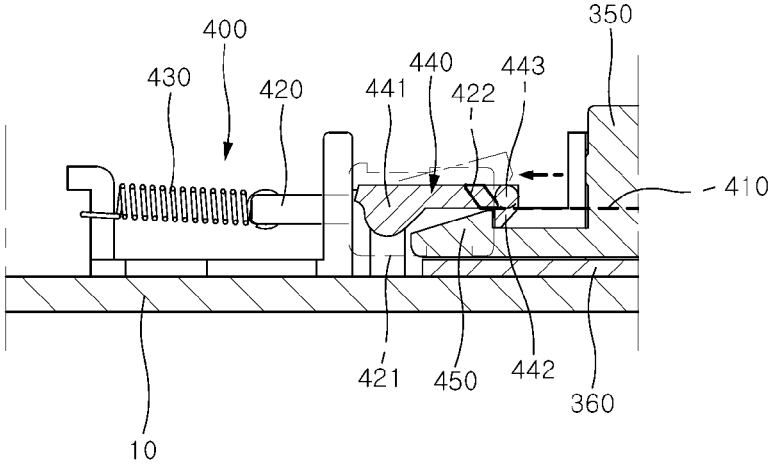
Figure 17:
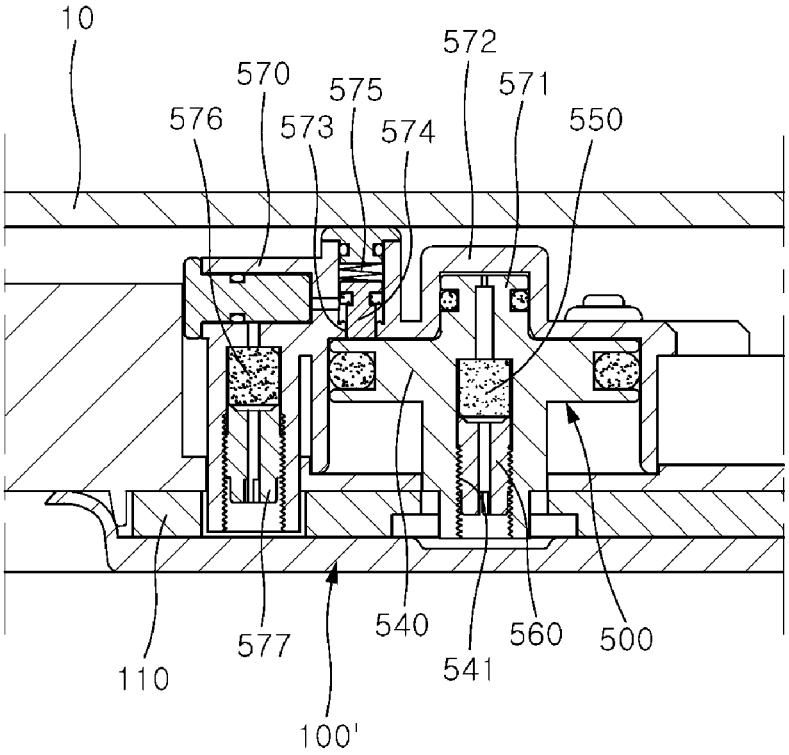

Further, as shown in FIG. 16, when the gap between the toilet seat 10 and the body sensing unit 100' decreases and the tension of the unloading wire 410 of the unloading unit 400 fixed at the first end to the body sensing unit 100' is removed, the unloading wire-fixing body 421 of the unloading wire-fixing member 420 and the unloading wire 410 are pulled by the restoring force of the unloading wire-supporting member 430 connecting the loading guide-guiding member 360 and the unloading wire-fixing member 420 so that the tension of the unloading wire 410 is maintained.

The unloading wire-fixing body 421 of the unloading wire-fixing member 420 pulled by the restoring force of the unloading wire-supporting member 430 moves toward the unloading wire-supporting member 430, whereby the unloading wire projection 422 protruding on the unloading wire-fixing body 421 comes in close contact with the unloading wire projection 443 of the unloading member 440. Further, even in this state, the unloading wire-fixing body 421 is moved toward the unloading wire-supporting member 430 by the restoring force of the unloading wire-supporting member 430 and the unloading wire projection 422 is moved upward along the unloading sire projection 443, and when the unloading wire projection 422 passes the unloading wire projection 443, it is moved back downward by its own weight, the unloading wire projection 422 is positioned behind the unloading wire projection 443.

Further, as shown in FIGS. 13 to 17, as the gap between the toilet seat 10 and the body sensing unit 100' decreases, the vertical guide member 540 of the adjusting unit 500 fixed to the body sensing unit 100' moves to the top inside the adjusting body 510 and compresses the air inside the adjusting body 510, and the compressed air presses the cover member 520, passes through the open air exhaust hole 511, and is discharged to the outside through the anti-separation member 530.

As the vertical guide member 540 is moved to the top inside the adjusting body 510, the toilet paper-adjusting rib 571 of the toilet paper time-adjuster 570 is fitted into the rib groove 572, the vertical guide member 540 moved to the top inside the adjusting body 510 presses the toilet paper time-adjusting cover member 574, the toilet paper time-adjusting cover member 574 compresses the restoring member 575, moves to the top inside the adjusting body 510, and opens the toilet paper time-adjusting hole 573, and the air inside the adjusting body 510 is discharged outside through the open toilet paper time-adjusting hole 573.

When the toilet paper time-adjusting rib 571 is fitted into the rib groove 572, the air in the rib groove 572 is discharged outside the adjusting body 510 through the urine adjusting hole 218. The urine adjusting hole 218 has been closed by the urine cover member 219 by the restoring force of the restoring member 220, but, as the pressure of the air inside the rib groove 572 is increased, the urine cover member 219 and the restoring member 220 are pushed and the urine adjusting hole 218 is opened. Further, since the air guide groove 218' is formed on the urine adjusting hole 218, the air inside the rib groove 572 can be discharged outside even though the urine cover member 219 is inserted in the urine adjusting hole 218.

It is possible to adjust the amount of the air that is discharged through the toilet paper time-adjusting hole 573 and the urine adjusting hole 218 in accordance with the compressed degree of the air adjusting filters 576 and 221 by the toilet paper time-adjusting bolt 577 and the urine adjusting bolt 222 inserted in the toilet paper time-adjusting hole 573 and the urine adjusting hole 218, using the air adjusting filters 576 and the 221 in the toilet paper time-adjusting hole 573 and the urine adjusting hole 218.

Figure 18:
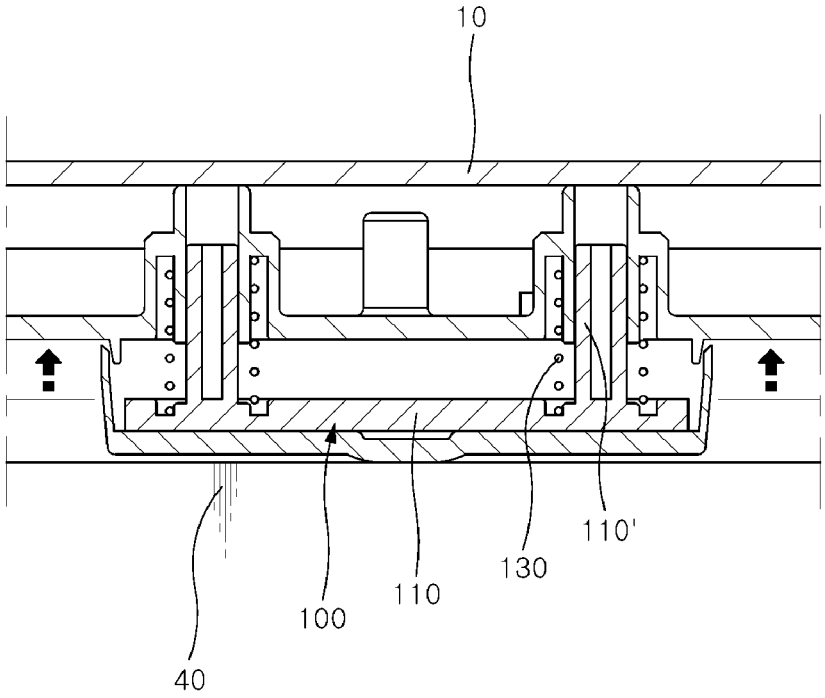
FIGS. 18 to 29 are views showing operation when a user stands up from the toilet seat of the present invention.
Figure 19:
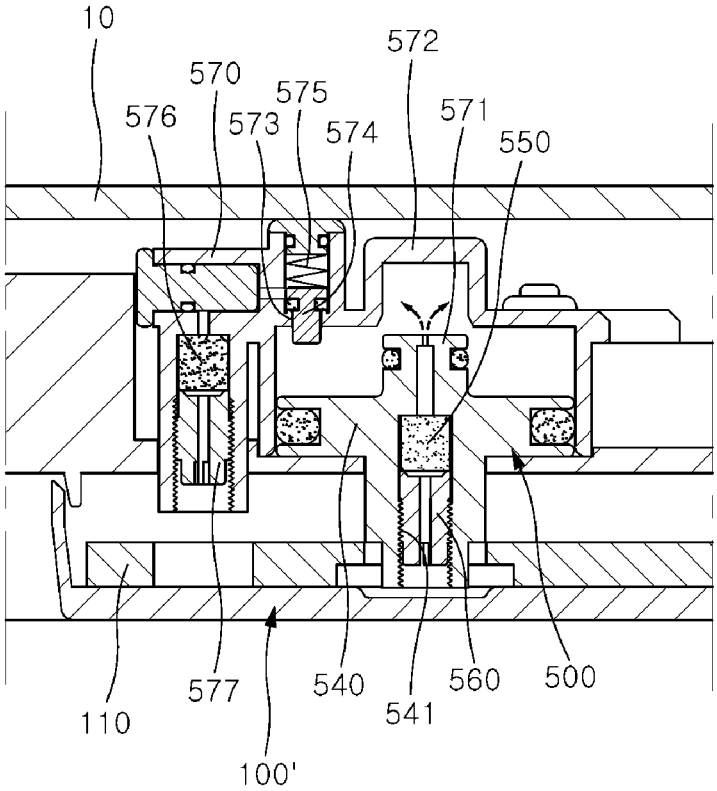
Figure 20:
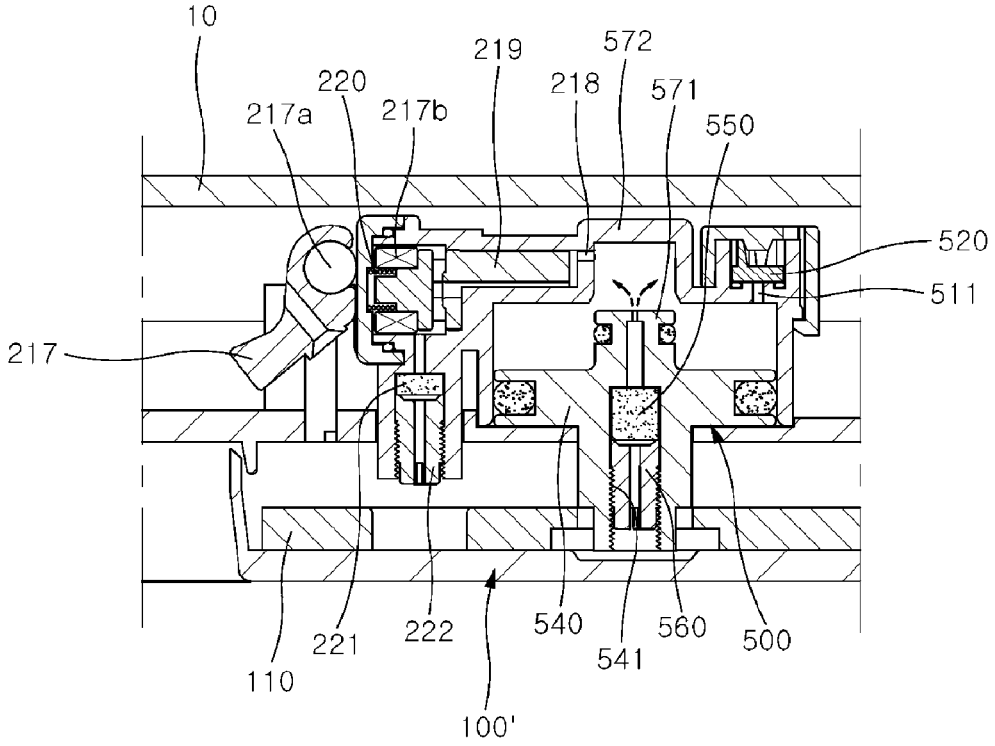

When the user stands up from the toilet seat 10 after excreting on the toilet seat 10, as shown in FIG. 18, the gap between the toilet seat 10 and the body sensing unit 100 and 100' is increased by restoring force of the seat springs 130 of the body sensing unit 100 and 100', and as shown in FIGS. 19 and 20, the vertical guide member 540 fixed to the body sensing unit 100' is moved to the bottom inside the adjusting body 510 and the pressure inside the adjusting body 510 is reduced, so the air outside the adjusting member 510 is sucked.

Since the air exhaust hole 511 of the adjusting body 510 is closed by the cover member 520, the external air cannot be sucked, so the toilet paper time-adjusting rib 571 protruding on the top of the adjusting body 510 is moved to the lower end of the rib groove 572 and the external air is sucked inside through the urine adjusting hole 218, the toilet paper time-adjusting hole 573, and the hole 541. In this process, since the air adjusting filters 221, 550, and 576 are disposed in the urine adjusting hole 218, the hole 541, and the toilet paper time-adjusting hole 573 by the urine adjusting bolt 222, the bolt 560, and the toilet paper time-adjusting bolt 577, so the amount of air can be adjusted in accordance with the compressed degree of the air adjusting filters.

A sealing member (not shown) is disposed on the inner side of the rib groove 572 for the toilet paper time-adjusting rib 571 and delays the time when the toilet paper time-adjusting rib 571 is separated from the rib groove 572, and the delayed time is the time that the user takes to dispose toilet paper.

As the toilet paper time-adjusting rib 571 is separated from the rib groove 572, the toilet paper time-adjusting cover member 574 with the pressing force by the vertical guide member 540 removed is moved down and closes the toilet paper time-adjusting hole 573 by the restoring force of the restoring member 575 and the restoring time of the vertical guide member 540 is delayed in accordance with the amount of the air sucked through the urine adjusting hole 218, in which the restoring time of the vertical guide member 540 is the operation time of the operation unit 300.

Figure 21:
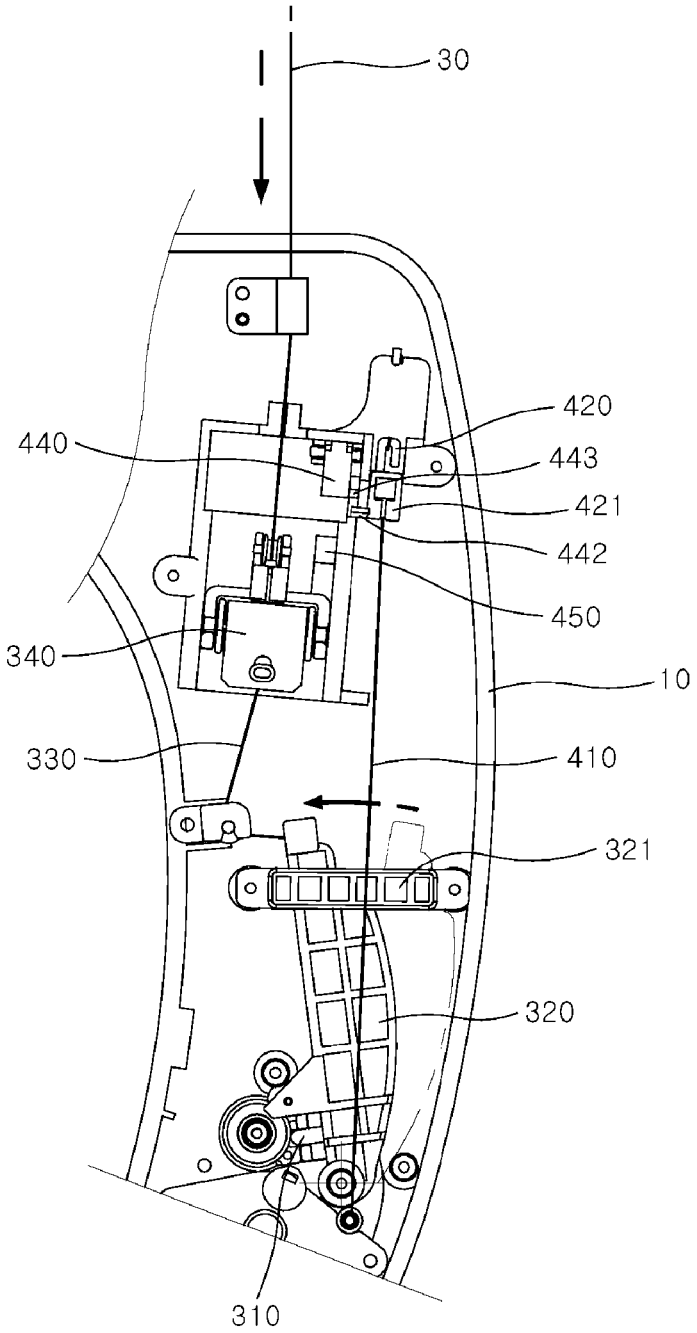
Figure 22:
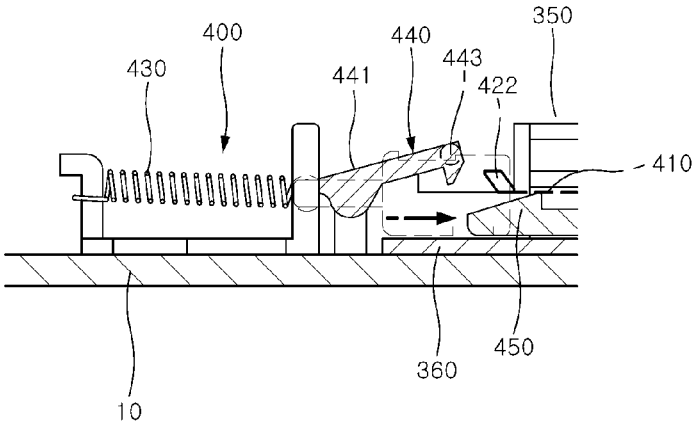
Figure 23:
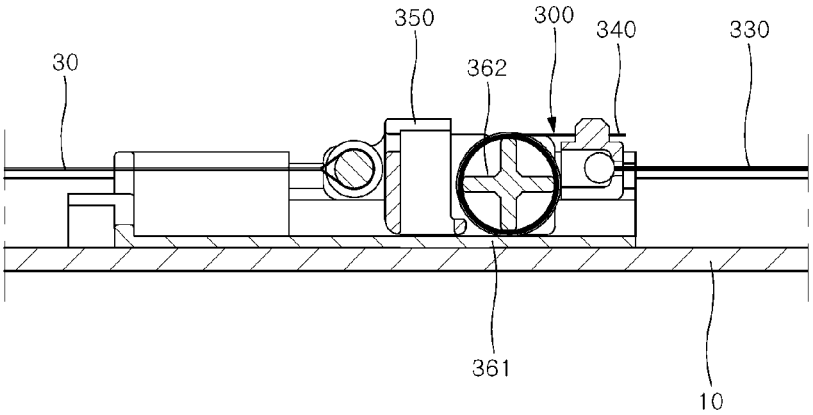

Further, as shown in FIGS. 21 to 23, as the gap between the toilet seat 10 and the body sensing unit 100' is increased by the seat springs 130 of the body sensing unit 100' and accordingly the unloading wire 410 fixed at the first end to the body sensing unit 100' is tensed, the unloading wire-fixing member 420 and the unloading wire-support member 430 are pulled and moved by the tension of the unloading wire 410.

With the movement of the unloading wire-fixing member 420, when the unloading wire projection 422 presses the unloading wire projection 443 of the unloading member 440, the unloading wire projection 443 is moved up along the inclined surface of the unloading wire projection 422 and the unloading projection 442 of the unloading member 440 is separated from the loading projection 450, so the coupling force of the unloading projection 442 and the loading projection 450 is removed.

When the coupling force of the unloading projection 442 and the loading projection 450 is removed, the loading guide 350 and the flushing wire 30 connected to the loading guide 350 are instantaneously pulled and moved by the loading force of the loading member 340, in which the moving guide projection 352 protruding on the loading guide body 351 of the loading guide 350 moves toward the front of the guide body 361 along the guide groove 362 of the loading guide member 360 and the siphon cover 20 fixing the flushing wire 30 opens the exit of an overflow pipe by being rotated upward about the overflow pipe so that the water in a water tank is supplied to the toilet body 10 through the open exit.

Figure 24:
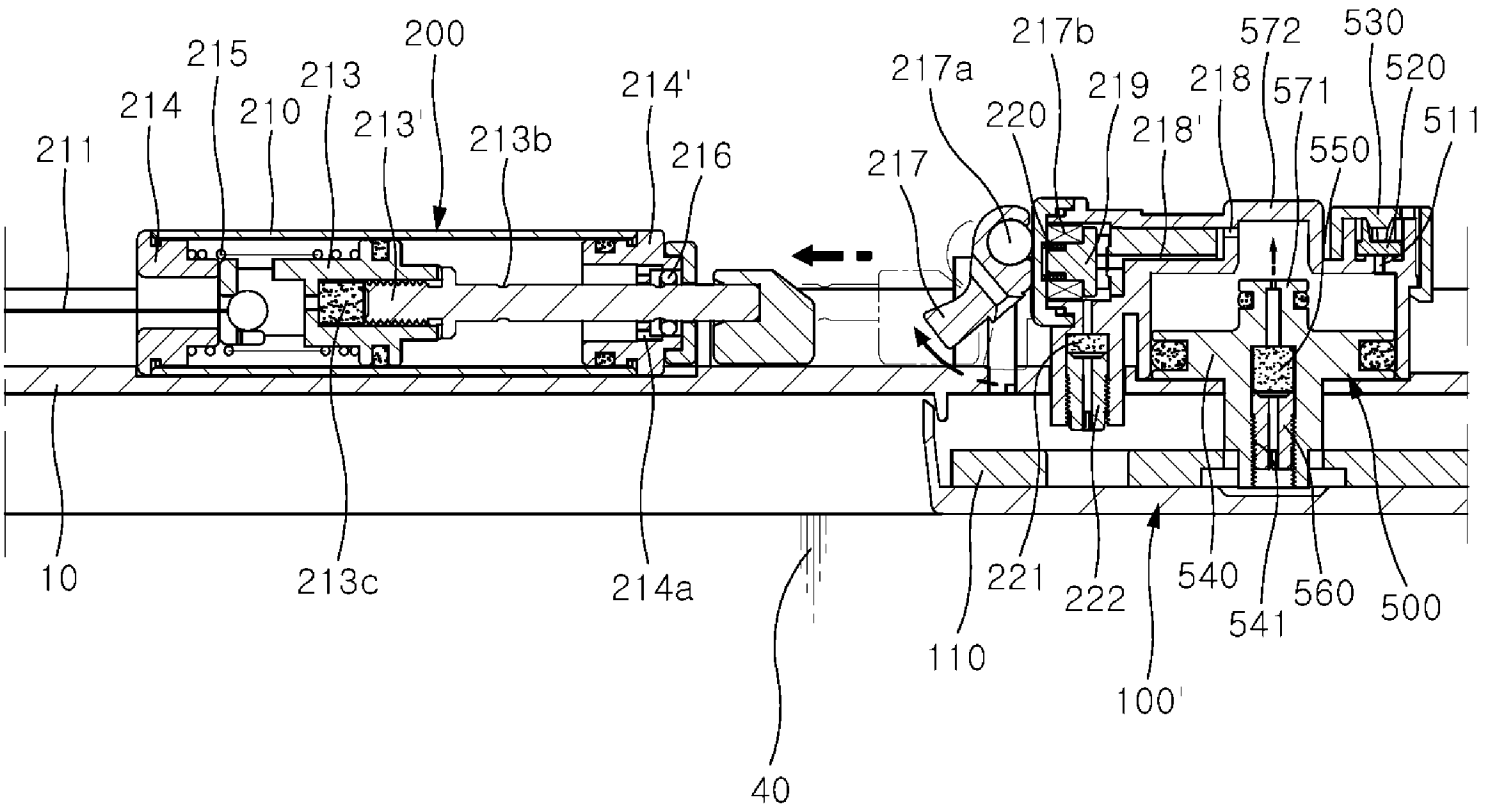

As for the water supplied to the toilet body 10 from the water tank, as shown in FIG. 24, it is possible to adjust the time for the vertical guide member 540 moving to the bottom inside the adjusting body 510 on the basis of the amount of air sucked through the air guide groove 218' and the amount of air sucked through the urine adjusting hole 218 of the urine cover member 219 by closing the urine adjusting hole 218 of the excreta discriminating unit 200, so water corresponding to the excreta of the user discriminated on the basis of whether of contact of the cylinder rod 213' and the excreta mode-switching member 217 can be supplied to the toilet body 10, thereby removing the excreta, when the weight of the user is removed.

Figure 25:
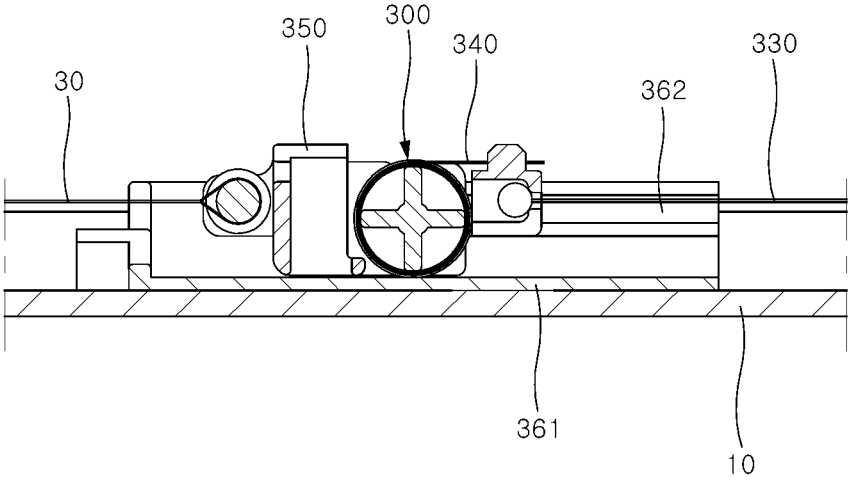
Figure 26:
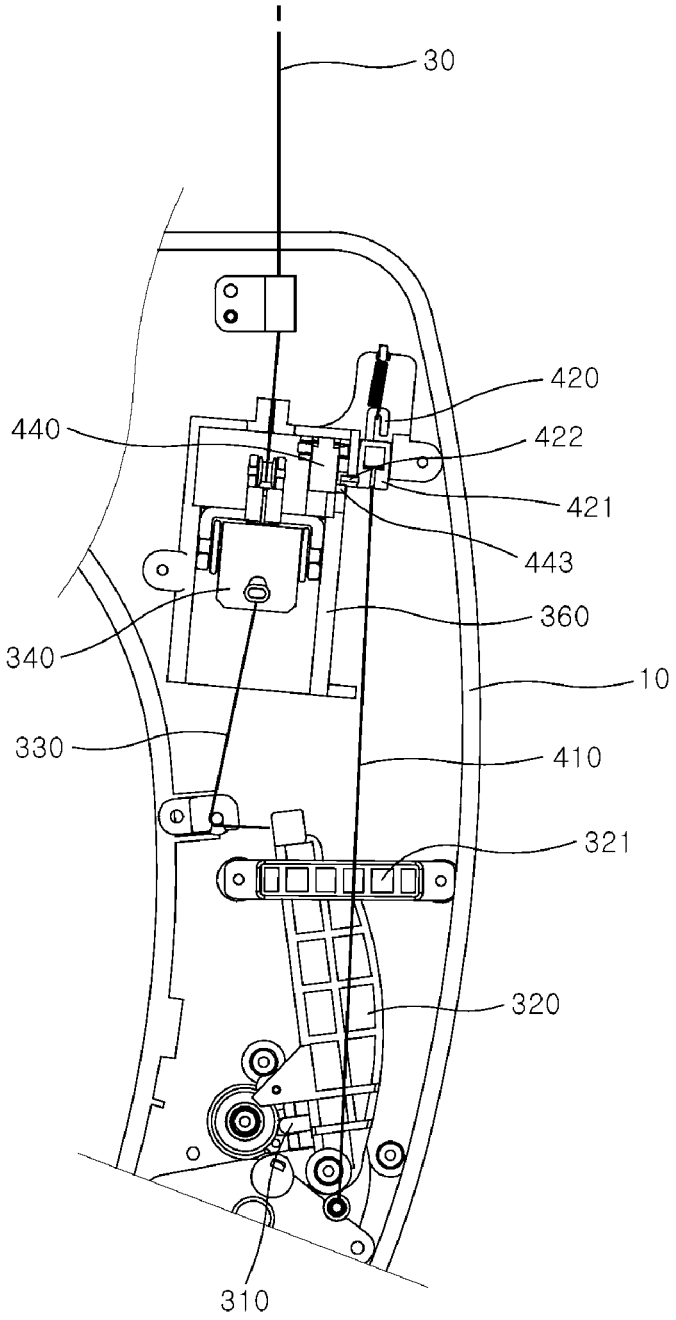

Since the gap between the toilet seat 10 and the body sensing unit 100' has been increased, as the pressing force applied to the lever 320 by the pressing member 310 is removed after the excreta is removed through the process described above, as shown in FIGS. 25 and 26, the siphon cover 20 is rotated downward by its own weight and closes the exit of the overflow pipe, the flushing wire 30 and the loading guide 350 are pulled by the siphon cover 20 rotated downward, and the moving guide projection 352 protruding on the loading guide body 351 is moved to the rear portion of the guide body 361 along the guide groove 362 of the loading guide-guiding member 360.

While the loading guide 350 moves to the rear portion of the loading guide-guiding member 360, the loading projection 450 pushes up the unloading projection 442 of the unloading member 440 and passes the unloading projection 442, and accordingly, the unloading member 440 is moved down by its own weight and the unloading projection 442 and the loading projection 450 are coupled.

Further, while the loading guide 350 is moved to the rear portion of the loading guide-guiding member 360, the loading member 340 is restored by its own elasticity and pulls the loading wire 330 connected to the loading member 340, the loading wire 330 pulls the lever 320 with the pressing force by the pressing member 310 removed, and the lever 320 is rotated from the first side to the second side about the end.

Figure 27:
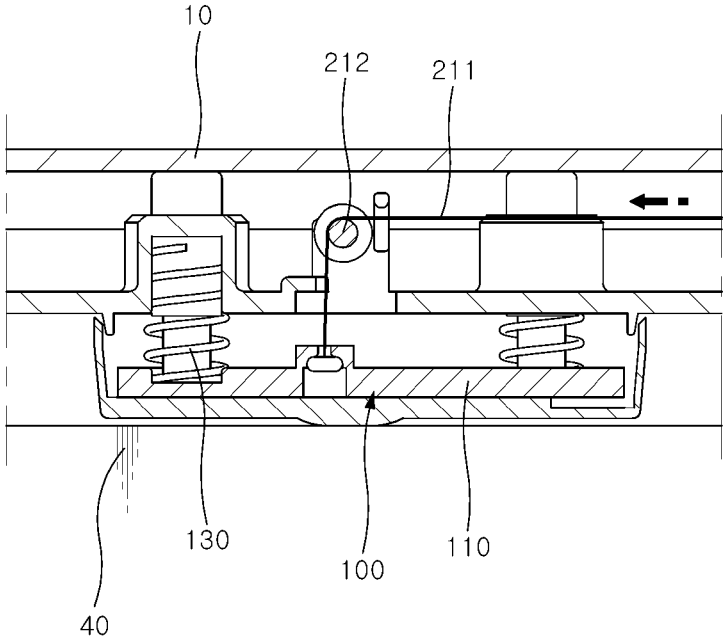

Further, as the gap between the toilet seat 10 and the body sensing unit 100 is increased by the restoring force of the seat springs 130 of the body sensing unit 100 and the cylinder wire 211 is tensed, as shown in FIG. 27, the cylinder spring 215 is compressed and the rod pin 213 and the cylinder rod 213' are pulled and moved by the tension of the cylinder wire 211. Further, when the packing 216 is moved to the coupling groove 213*b*' over the coupling groove 231*b* by the movement of the cylinder rod 213', the inner side of the second cap 214' and the groove 214*a* are opened and air is sucked inside. Furthermore, as the rod pin 213 and the cylinder rod 213' are moved, the air inside the cylinder body 210 is discharged through the air adjusting filter 213*c* and the first cap 214.

Figure 28:
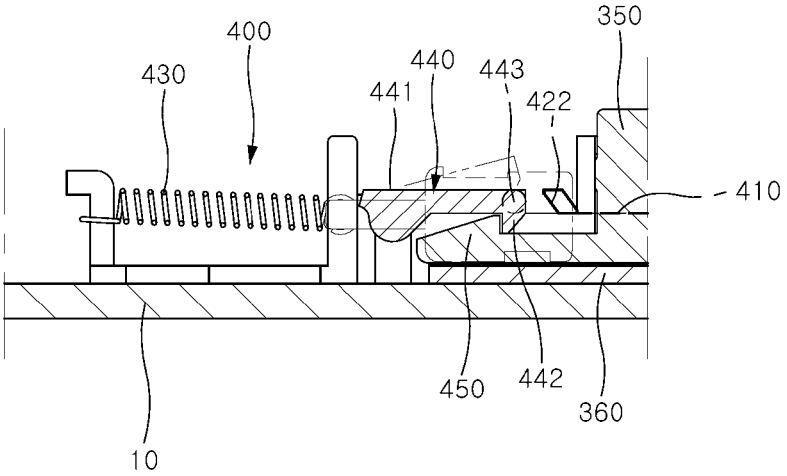
Figure 29:
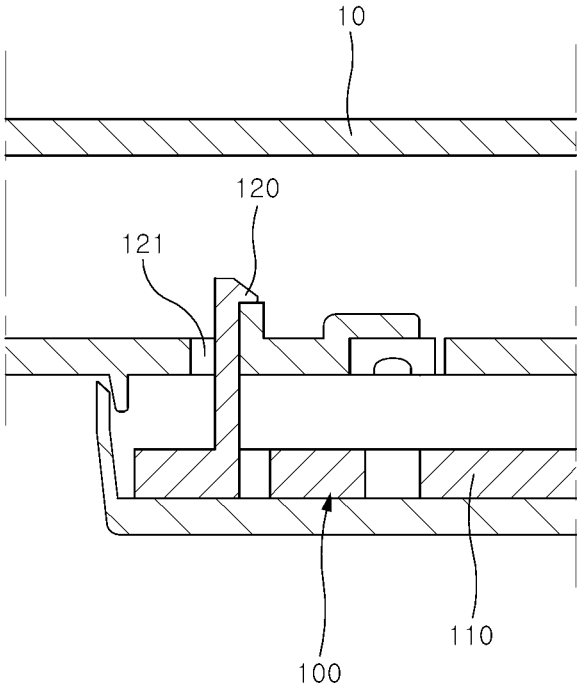

Further, as the gap between the toilet seat 10 and the body sensing unit 100' is increased by the restoring force of the seat springs 130 of the body sensing unit 100' and the unloading wire 410 is tensed, as shown in FIG. 28, the unloading wire-supporting member 430 is stretched and the unloading wire-fixing member 420 is pulled by the tension of the unloading wire 410, so the unloading wire projection 422 is positioned at the end of the unloading wire projection 443. Further, as shown in FIG. 29, as the gap between the toilet seat 10 and the body sensing unit 100 and 100' is increased, the hook 120 is locked into the hook hole 121, thereby standing by the next operation.

The contact members 217*a* and 217*b* may be both magnets, or one of them may be a magnet and the other one may be a metallic part.

Although the present invention was described above with reference to limitative embodiments and drawings, the terminologies and terms used in the specification and claims should not be construed as being limited to common or dictionary meanings, but should be construed as being meanings corresponding to the spirit of the present invention. Therefore, the configurations described in the embodiments and drawings of the present invention are merely most preferable embodiments but do not represent all of the technical spirit of the present invention. Thus, the present invention should be construed as including all the changes, equivalents, and substitutions without departing from the claims.

The invention claimed is:

1. A powerless automatic flushing toilet seat for a water tank having air exhaust and intake functions only through human body weight, the toile toilet seat comprising:

a body sensing unit (100, 100') pressing seat springs (130) and guiding a toilet seat (10) that moves down when a user sits on the toilet seat (10), and guiding the toilet seat (10) that moves up using a restoring force of the seat springs (130) when the user stands up from the toilet seat (10);

an operation unit (300) including a loading member (340) for pulling a flushing wire (30) connected to a siphon cover (20) in response to downward movement of the body sensing unit (100'), and removing excreta with rotation of the siphon cover (20) by removing a loading force of the loading member (340) and pulling the flushing wire (30) through an unloading member (440) operating in response to upward movement of the body sensing unit (100');

an unloading unit (400) keeping a loading force in the flushing wire (30) in response to downward movement of the body sensing unit (100') and removing the kept loading force in response to upward movement of the body sensing unit (100'); and an adjusting unit (500) adjusting operation time of the operation unit (300) by discharging internal air in response to downward movement of the body sensing unit (100') and by adjusting the amount of air flowing inside in response to upward movement of the body sensing unit (100') at a compressed level of an air adjusting filter (550) by a bolt (560).

2. The toilet seat of claim 1, wherein the body sensing unit (100, 100') includes:

a sensing plate (110) coupled to a toilet through a hole (11) formed in the toilet seat (10);

a hook (120) coupled to a hook hole (121) formed through the toilet (10) to prevent separation of the sensing plate (110) from the toilet seat (10); and seat springs (130) disposed between the sensing plate (110) and the toilet seat (10) to restore the toilet seat (10).

3. The toilet seat of claim 1, wherein the operation unit (300) includes:

a pressing member (310) mounted on the sensing plate (110) coupled to the body sensing unit (100');

a lever (320) rotating from a first side to a second side about an end of the toilet seat (10) when being pressed by the pressing member (310);

a loading wire (330) pulling the loading member (340) when the lever (320) is rotated;

the loading member (340) fixed to the loading wire (330) and keeping a force for pulling the flushing wire (30) when the lever (320) is rotated;

a loading guide (350) fixing the flushing wire (30) and guiding the loading member (340); and a loading guide-guiding member (360) guiding the loading guide (350).

4. The toilet seat of claim 3, wherein the loading member (340) is any one of a spiral spring, a leaf spring, and a coil spring.

5. The toilet seat of claim 3, wherein the loading guide (350) has:

a guide body (351) accommodating the loading member (340) and fixing the flushing wire (30); and guide projections (352) protruding at both sides of the guide body (351) to be fitted in guide grooves (362) of the loading guide-guiding member (360).

6. The toilet seat of claim 3, wherein the loading guide-guiding member (360) has:

a guide body (361) accommodating the loading guide (350) and being fixed to the toilet seat (10); and guide grooves (362) formed inside the guide body (361) and retaining moving guide projections (352) of the loading guide (350).

7. The toilet seat of claim 1, wherein the unloading member (400) includes:

an unloading wire (410) fixed to a side of the body sensing unit (100');

an unloading wire-fixing member (420) fixing a second end of the unloading wire (410) and controlling operation of the unloading member (440) when the unloading wire (410) is tensed;

an unloading wire-supporting member (430) fixed to the operation unit (300) and the unloading wire-fixing member (420) to elastically support the unloading wire-fixing member (420) and the unloading wire (410);

the unloading member (440) unlocking a loading guide-guiding member (360) of the operation unit (300) when the unloading wire-fixing member (420) is moved; and a loading projection (450) protruding on a loading guide (350) to keep the unloading member (400) locked.

8. The toilet seat of claim 7, wherein the unloading wire-fixing member (420) has:

an unloading wire-fixing body (421) fixing the second end of the unloading wire (410); and an unloading wire projection (422) protruding on the unloading wire-fixing body (421) and pressing the unloading member (440) when the unloading wire (410) is moved.

9. The toilet seat of claim 8, wherein the unloading wire projection (422) is inclined.

10. The toilet seat of claim 7, wherein the unloading wire-supporting member (430) is a spring that pulls the unloading wire-fixing member (420).

11. The toilet seat of claim 7, wherein the unloading member (440) has:

an unlocking body (441) mounted on a loading guide-guiding member (360 to fit to the loading projection (450); and an unloading projection (442) protruding on a side of the unlocking body (441) to be pressed by a unloading wire projection (422) of the unloading wire-fixing member (420).

12. The toilet seat of claim 1, wherein the adjusting unit (500) includes:

an adjusting body (510) having an air exhaust hole (511) and being fixed to the toilet seat (10);

a cover member (520) opening and closing the air exhaust hole (511);

an anti-separation member (530) preventing separation of the cover member (520); and a vertical guide member (540) discharging air in the adjusting body (510) to the air exhaust hole (511) by vertically moving in the adjusting body (510) and being fixed to the body sensing unit (100') to suck air outside the adjusting body (510).

13. The toilet seat of claim 12, further comprising:

an air adjusting filter (550) coupled to a hole (541) formed through the vertical guide member (540) to adjust the amount of air flowing inside through the hole (541); and a bolt (560) inserted in the hole (541) to prevent separation of the air adjusting filter (550) and adjust the movement amount of the air in accordance with the degree of compression of the air adjusting filter (550).

14. The toilet seat of claim 12, further comprising a toilet paper-disposal time adjuster (570) adjusting time for a user to dispose toilet paper by adjusting downward movement time of the vertical guide member (540).

15. The toilet seat of claim 14, wherein the toilet paper-disposal time adjuster (570) includes:

a toilet paper time-adjusting rib (571) protruding on a top of the vertical guide member (540);

a rib groove (572) formed on the adjusting body (510) to receive the toilet paper time-adjusting rib (571);

a toilet paper time-adjusting hole (573) formed through the adjusting body (510); and a toilet paper time-adjusting cover member (574) inserted in the toilet paper time-adjusting hole (573) so that the toilet paper time-adjusting rib (571) opens and closes the toilet paper time-adjusting hole (573) by being coupled to and separated from the rib groove (572).

16. The toilet seat of claim 15, further comprising a restoring member (575) guiding the toilet paper time-adjusting cover member (574) that is restored.

17. The toilet seat of claim 15, further comprising:

an air adjusting filter (576) coupled to an end of the toilet paper time-adjusting hole (573) to adjust the amount of air flowing inside through the toilet paper time-adjusting hole (573); and a toilet paper time-adjusting bolt (577) inserted in the toilet paper time-adjusting hole (573) to prevent separation of the air adjusting filter (576) and adjust movement amount of the air in accordance with the degree of compression of the air adjusting filter (576).

18. The toilet seat of claim 1, further comprising: an excreta discriminating unit, wherein the excreta discriminating unit (200) includes:

a cylinder wire (211) fixed at a first end to the body sensing unit (100);

a rod pin (213) fixing a second end of the cylinder wire (211), combined with a cylinder rod (213'), and coupled to a cylinder body (210);

a first cap (214) preventing separation of the rod pin (213) and coupled to a first end of the cylinder body (210); a second cap (214') coupled to a second end of the cylinder body (210) to guide the cylinder rod (213') and guiding air inside and outside the cylinder body (210) when the cylinder rod (213') is moved;

a cylinder spring (215) disposed between the first cap (214) and the second cap (214');

a packing (216) fitted on the cylinder rod (213') and disposed between the second cap (214') and the cylinder rod (213');

an excreta mode-switching unit (217) discriminating excreta on the basis of whether of contact of a contact member (217') by the cylinder rod (213') moved by a restoring force of the cylinder spring (215); and a urine cover member (219) opening and closing a urine amount-adjusting hole (218) formed through a rib groove (572) of a toilet paper-disposal time adjuster (570) using a restoring force of a restoring member (220) on the basis of whether of contact of the excreta mode-switching unit (217).

19. The toilet seat of claim 18, further comprising a roller (212) on the body sensing unit (100) to guide the cylinder wire (211).

20. The toilet seat of claim 18, further comprising coupling grooves (**213*b*, 213*b'*) allowing a packing (216) to move to connect air inside and outside the cylinder body (210) when the rod pin (213) returns while compressing the cylinder spring (215) and when the cylinder rod (213') presses the excreta mode-switching member (217**).

21. The toilet seat of claim 18, further comprising:

an air adjusting filter (221) coupled to an end of the urine adjusting hole (218) to adjust the amount of air flowing inside through the urine adjusting hole (218); and a urine adjusting bolt (222) inserted in the urine adjusting hole (218) to prevent separation of the air adjusting filter (221) and adjust movement amount of the air in accordance with the degree of compression of the air adjusting filter (221).

22. The toilet seat of claim 18, further comprising an air adjusting filter (213*c*) disposed between the cylinder rod (213') and the rod pin (213) to adjust the amount of air flowing inside and outside the cylinder body (210) through a hole (213*a*) formed through the rod pin (213) combined with the cylinder rod (213').

23. A powerless automatic flushing toilet seat for a water tank, comprising:

a body sensing unit (100, 100') pressing seat springs (130 and guiding a toilet seat (10) that moves down when a user sits on the toilet seat (10, and guiding the toilet seat (10) that moves up using a restoring force of the seat springs (130) when the user stands up from the toilet seat (10);

an operation unit (300) including a loading member (340) for pulling a flushing wire (30) connected to a siphon cover (20) in response to downward movement of the body sensing unit (100'), and removing excreta with rotation of the siphon cover (20) by removing the loading force of the loading member (340) and pulling the flushing wire (30) through an unloading member (440) operating in response to upward movement of the body sensing unit (100'); and an unloading unit (400) keeping a loading force in the flushing wire (30) in response to downward movement of the body sensing unit (100') and removing the kept loading force in response to upward movement of the body sensing unit (100').

24. The toilet seat of claim 23, wherein the body sensing unit (100, 100') includes:

a sensing plate (110) coupled to a toilet through a hole (11) formed in the toilet seat (10);

a hook (120) coupled to a hook hole (121) formed through the toilet (10) to prevent separation of the sensing plate (110) from the toilet seat (10); and seat springs (130) disposed between the sensing plate (110) and the toilet seat (10) to restore the toilet seat (10).

25. The toilet seat of claim 23, wherein the operation unit (300) includes:

a pressing member (310) mounted on the sensing plate (110) coupled to the body sensing unit (100');

a lever (320) rotating from a first side to a second side about an end of the toilet seat (10) when being pressed by the pressing member (310);

a loading wire (330) pulling the loading member (340) when the lever (320) is rotated;

the loading member (340) fixed to the loading wire (330) and keeping a force for pulling the flushing wire (30) when the lever (320) is rotated;

a loading guide (350) fixing the flushing wire (30) and guiding the loading member (340); and a loading guide-guiding member (360) guiding the loading guide (350).

26. The toilet seat of claim 25, wherein the loading member (340) is any one of a spiral spring, a leaf spring, and a coil spring.

27. The toilet seat of claim 25, wherein the loading guide (350) has:

a guide body (351) accommodating the loading member (340) and fixing the flushing wire (30); and guide projections (352) protruding at both sides of the guide body (351) to be fitted in guide grooves (362) of the loading guide-guiding member (360).

28. The toilet seat of claim 25, wherein the loading guide-guiding member (360) has:

a guide body (361) accommodating the loading guide (350) and being fixed to the toilet seat (10); and guide grooves (362) formed inside the guide body (361) and retaining moving guide projections (352) of the loading guide (350).

29. The toilet seat of claim 23, wherein the unloading member (400) includes:

an unloading wire (410) fixed to a side of the body sensing unit (100');

an unloading wire-fixing member (420) fixing a second end of the unloading wire (410) and controlling operation of the unloading member (440) when the unloading wire (410) is tensed;

an unloading wire-supporting member (430) fixed to the operation unit (300) and the unloading wire-fixing member (420) to elastically support the unloading wire-fixing member (420) and the unloading wire (410);

the unloading member (440) unlocking a loading guide-guiding member (360) of the operation unit (300) when the unloading wire-fixing member (420) is moved; and a loading projection (450) protruding on a loading guide (350) to keep the unloading member (400) locked.

30. The toilet seat of claim 29, wherein the unloading wire-fixing member (420) has:

an unloading wire-fixing body (421) fixing the second end of the unloading wire (410); and an unloading wire projection (422) protruding on the unloading wire-fixing body (421) and pressing the unloading member (440) when the unloading wire (410) is moved.

31. The toilet seat of claim 30, wherein the unloading wire projection 422 is inclined.

32. The toilet seat of claim 29, wherein the unloading wire-supporting member (430) is a spring that pulls the unloading wire-fixing member (420).

33. The toilet seat of claim 29, wherein the unloading member (440) has:

an unlocking body (441) mounted on a loading guide-guiding member (360 to fit to the loading projection (450); and an unloading projection (442) protruding on a side of the unlocking body (441) to be pressed by a unloading wire projection (422) of the unloading wire-fixing member (420), detecting the weight of a user.

* * * * *